US010207159B2

(12) United States Patent
Onuki et al.

(10) Patent No.: US 10,207,159 B2
(45) **Date of Patent: *Feb. 19, 2019**

(54) GOLF CLUB

(71) Applicant: SUMITOMO RUBBER INDUSTRIES, LTD., Kobe-shi (JP)

(72) Inventors: Masahide Onuki, Kobe (JP); Yuki Motokawa, Kobe (JP); Naruhiro Mizutani, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/688,327

(22) Filed: Aug. 28, 2017

(65) Prior Publication Data

US 2018/0078829 A1 Mar. 22, 2018

(30) Foreign Application Priority Data

Sep. 21, 2016 (JP) ..... 2016-183777

(51) Int. Cl.

| | |
|---|---|
| ***A63B 53/02*** | (2015.01) |
| ***A63B 53/00*** | (2015.01) |
| ***A63B 53/04*** | (2015.01) |
| *A63B 102/32* | (2015.01) |

(52) U.S. Cl.

CPC ..... *A63B 53/02* (2013.01); *A63B 53/007* (2013.01); *A63B 53/047* (2013.01); *A63B 53/0466* (2013.01); *A63B 2053/027* (2013.01); *A63B 2102/32* (2015.10); *A63B 2225/093* (2013.01)

(58) Field of Classification Search

CPC ..... A63B 53/02; A63B 53/007; A63B 53/047; A63B 2225/093; A63B 53/0466

See application file for complete search history.

(56) References Cited

U.S. PATENT DOCUMENTS

| | | | | |
|---|---|---|---|---|
| 5,851,155 | A * | 12/1998 | Wood | A63B 53/02 473/246 |
| 2010/0234123 | A1 | 9/2010 | Sato et al. | |
| 2012/0142445 | A1 | 6/2012 | Burnett et al. | |
| 2012/0190474 | A1* | 7/2012 | Sato | A63B 53/02 473/305 |
| 2014/0051527 | A1 | 2/2014 | Sato | |
| 2014/0206469 | A1* | 7/2014 | Girard | A63B 53/06 473/287 |

* cited by examiner

*Primary Examiner* — Michael Dennis

(74) *Attorney, Agent, or Firm* — Birch, Stewart, Kolasch & Birch, LLP

(57) ABSTRACT

A shaft of a golf club includes a reverse-tapered engagement part. The reverse-tapered engagement part includes a sleeve having a reverse-tapered shape, and a reverse-tapered outer surface. A hosel part of a head includes a reverse-tapered inner surface and a hosel slit. A hosel hole includes the reverse-tapered inner surface having a shape corresponding to that of the reverse-tapered outer surface. Either one of the reverse-tapered outer surface and the reverse-tapered inner surface includes an abutting engagement surface and a non-abutting engagement surface. The other of the reverse-tapered outer surface and the reverse-tapered inner surface includes a first abutting surface and the second abutting surface. In the golf club, a first state and a second state in which club lengths are different from each other can be achieved.

11 Claims, 21 Drawing Sheets

GOLF CLUB

The present application claims priority on Patent Application No. 2016-183777 filed in JAPAN on Sep. 21, 2016, the entire contents of which are hereby incorporated by reference.

BACKGROUND OF THE INVENTION

Field of the Invention

The present invention relates to a golf club.

Description of the Related Art

A golf club including a shaft attaching/detaching mechanism to which a club length adjustment mechanism is added has been proposed.

Japanese Patent Application Publication No. 2010-213859 (US2010/0234123) discloses a golf club having a spacer bonded to a tip of a shaft, a first screw member capable of being screw-connected to an upper end part of a hosel, and a second screw member capable of being screw-connected to both the first screw member and the upper end part of the hosel. The club length can be changed by the presence or absence of the spacer and the second screw member.

Japanese Patent Application Publication No. 2014-36809 (US2014/0051527) discloses a golf club including a shaft case fixed to a tip portion of a shaft, and a spacer having a plurality of slits each having a different depth from each other. An insertion depth of the shaft case to the hosel can be changed by changing a slit with which a key part is engaged.

US2012/0142445 discloses a golf club: in which a spacer capable of connecting to a retainer and to a shaft sleeve is provided at a lower end of the shaft sleeve; and a hosel sleeve is provided on an upper part of a hosel. The club length can be changed by the presence or absence of the spacer and the hosel sleeve.

SUMMARY OF THE INVENTION

In one aspect, a golf club may include a head having a hosel part, a shaft, and a reverse-tapered engagement part disposed at a tip portion of the shaft. The reverse-tapered engagement part may include: a sleeve which has a reverse-tapered shape and is fixed to the tip portion of the shaft; and a reverse-tapered outer surface. The hosel part may include a hosel hole, and a hosel slit which is provided on a side of the hosel hole and enables the shaft to pass through the hosel slit. The hosel hole may have a reverse-tapered inner surface having a shape corresponding to a shape of the reverse-tapered outer surface. Either one of the reverse-tapered outer surface and the reverse-tapered inner surface may include an abutting engagement surface. The other of the reverse-tapered outer surface and the reverse-tapered inner surface may include a first abutting surface and a second abutting surface. A first state in which the abutting engagement surface abuts on the first abutting surface may be formed when the reverse-tapered outer surface is set on a first rotation position. A second state in which the abutting engagement surface abuts on the second abutting surface may be formed when the reverse-tapered outer surface is set on a second rotation position. An axial direction position of the reverse-tapered outer surface with respect to the reverse-tapered inner surface in the first state may be different from that of the second state, and a club length may be adjusted by the difference.

In another aspect, the reverse-tapered outer surface may include a non-abutting engagement surface in addition to the abutting engagement surface. The reverse-tapered outer surface may be a pyramid outer surface, and the abutting engagement surface and the non-abutting engagement surface may be alternately arranged on the pyramid outer surface. A radial direction position of the abutting engagement surface may be located outside with respect to a radial direction position of the non-abutting engagement surface. The reverse-tapered inner surface may be a pyramid inner surface corresponding to the pyramid outer surface, and the first abutting surface and the second abutting surface may be alternately arranged on the pyramid inner surface.

In another aspect, the pyramid outer surface may be an eight-sided pyramid surface. The pyramid inner surface may be an eight-sided pyramid surface.

In another aspect, the reverse-tapered engagement part may be constituted with the sleeve, and at least one spacer externally fitted to the sleeve.

In another aspect, an axis line of an inner surface of the spacer is inclined or parallel eccentric with respect to an axis line of an outer surface of the spacer.

In another aspect, a golf club may include a head having a hosel part, a shaft and a reverse-tapered engagement part disposed at a tip portion of the shaft. The reverse-tapered engagement part may include: a sleeve which has a reverse-tapered shape and is fixed to the tip portion of the shaft; and one or more spacers externally fitted to the sleeve. The sleeve may have a reverse-tapered outer surface. Each of the one or more spacers may have a reverse-tapered inner surface and the reverse-tapered outer surface. The hosel part may include a hosel hole; and a hosel slit which is provided on a side of the hosel hole and enables the shaft to pass through the hosel slit. The hosel hole may have a reverse-tapered inner surface having a shape corresponding to a shape of an outer surface of the reverse-tapered engagement part. Inside the reverse-tapered engagement part, a reverse-tapered fitting may be constituted with any one of the reverse-tapered outer surfaces and any one of the reverse-tapered inner surfaces. Either one of the reverse-tapered outer surface and the reverse-tapered inner surface with which the reverse-tapered fitting is constituted may include an abutting engagement surface. The other of the reverse-tapered outer surface and the reverse-tapered inner surface with which the reverse-tapered fitting is constituted may include a first abutting surface and a second abutting surface. A first state in which the abutting engagement surface abuts on the first abutting surface may be formed when the reverse-tapered outer surface which constitutes the reverse-tapered fitting is set on a first rotation position. A second state in which the abutting engagement surface abuts on the second abutting surface may be formed when the reverse-tapered outer surface which constitutes the reverse-tapered fitting is set on a second rotation position. An axial direction position of the reverse-tapered outer surface with respect to the reverse-tapered inner surface in the first state may be different from that of the second state, and a club length may be adjusted by the difference.

In another aspect, the reverse-tapered outer surface with which the reverse-tapered fitting is constituted may include a non-abutting engagement surface in addition to the abutting engagement surface. The reverse-tapered outer surface with which the reverse-tapered fitting is constituted may be a pyramid outer surface, and the abutting engagement surface and the non-abutting engagement surface may be alternately arranged on the pyramid outer surface. A radial direction position of the abutting engagement surface may be located outside with respect to a radial direction position of the non-abutting engagement surface. The reverse-tapered inner surface with which the reverse-tapered fitting is constituted may be a pyramid inner surface corresponding to the pyramid outer surface, and the first abutting surface and the second abutting surface may be alternately arranged on the pyramid inner surface. A mutual shifting between the first state and the second state may be performed by rotating the reverse-tapered outer surface, with which the reverse-tapered fitting is constituted, with respect to the reverse-tapered inner surface with which the reverse-tapered fitting is constituted.

In another aspect, the pyramid outer surface may be an eight-sided pyramid surface. The pyramid inner surface may be an eight-sided pyramid surface.

In another aspect, in at least one of the spacers, an axis line of an inner surface thereof may be inclined or parallel eccentric with respect to an axis line of an outer surface thereof.

In another aspect, an axis line of an inner surface of the sleeve may be inclined or parallel eccentric with respect to an axis line of an outer surface of the sleeve.

In another aspect, the head may further include a falling-off prevention part regulating a movement of the reverse-tapered engagement part in an engagement releasing direction.

DESCRIPTION OF THE PREFERRED EMBODIMENTS

Figure 1:
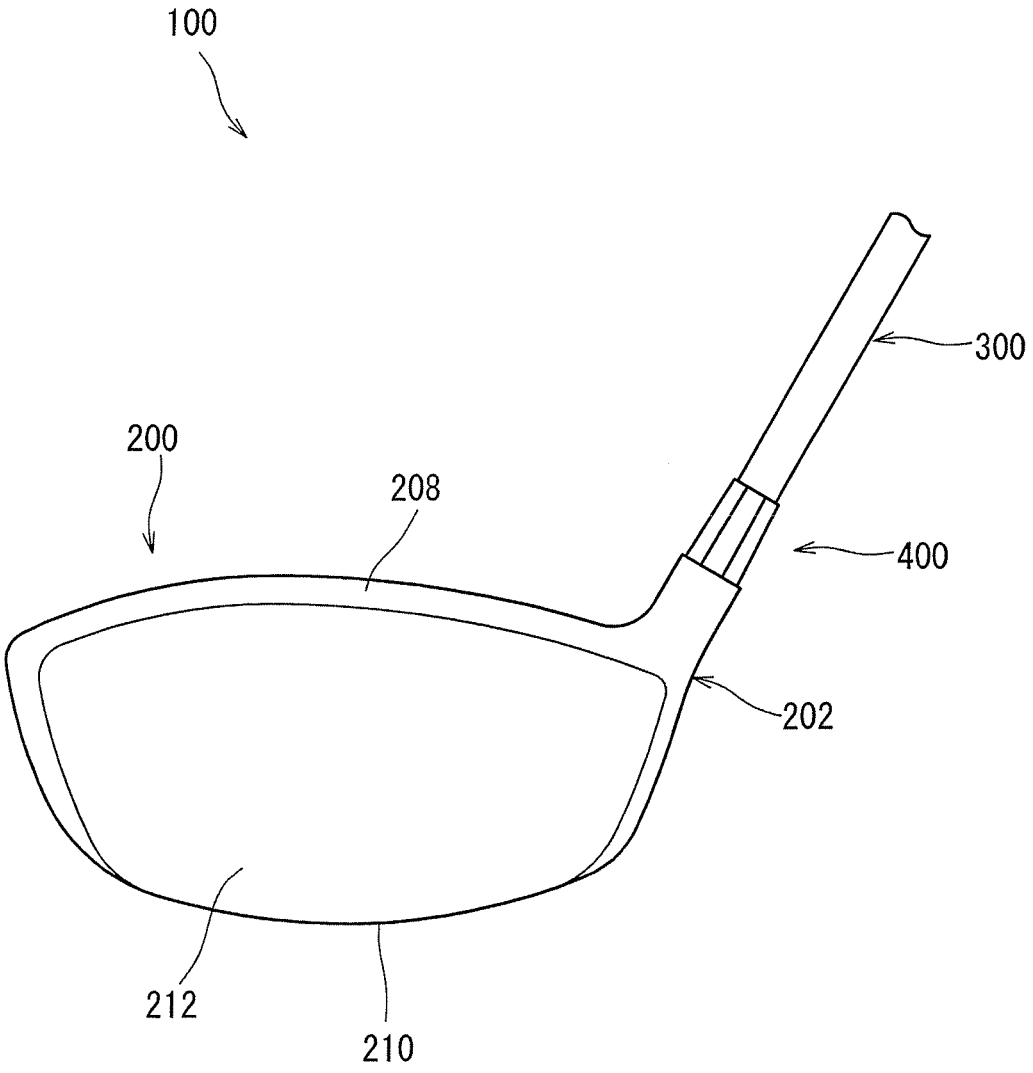
FIG. 1 is a front view of a golf club according to a first embodiment.

In a shaft attaching/detaching mechanism, a sleeve is fixed by using a screw. The screw may be connected to the sleeve from a lower side (sole side), or may be connected to the sleeve from an upper side (grip side).

A large centrifugal force acts on a head during swinging. In addition, a strong impact shock force caused by hitting acts on the head. A screw having sufficient strength is required so that the screw can endure the centrifugal force and the impact shock force. A screw having sufficient strength has a large mass. The mass of the screw hinders the weight saving of the head. The mass of the screw reduces the degree of freedom of the weight distribution of the head. The weight saving becomes more difficult by adding a club length adjustment mechanism to such an attaching/detaching mechanism. Thus, the degree of freedom of the weight distribution of the head is reduced and the degree of freedom in design of the head is also decreased.

In the type of a shaft attaching/detaching mechanism in which the shaft is fixed with a screw from a lower side, a position and an angle of the screw fixing the shaft are changed by inclination or movement of the sleeve. When change in the inclination direction of the shaft axis is large, changes in the position and the direction of the screw are also large. When the changes in the position and the angle of the screw are large, a surface on which a head part of the screw abuts cannot follow the changes in the position and the angle of the screw. For this reason, coaxial properties between the screw and a sleeve are lost, and deformation in which the screw or the sleeve is bent is imposed. The constitution may reduce the strength and the endurance of a shaft fixing structure. Due to the problem, the position and the angle of the screw are limited. That is, the adjustment ranges of a loft angle and a lie angle are restrained. Even if a club length adjustment mechanism is incorporated to the shaft attaching/detaching mechanism which has such problems, the problems of the shaft attaching/detaching mechanism is not solved. On the contrary, the constitution becomes further complicated by adding the club length adjustment mechanism and thus the strength and the endurance can further deteriorate.

The present disclosure provides a golf club capable of achieving a combination of a shaft attaching/detaching mechanism and a club length adjustment mechanism without using a complicated constitution.

Hereinafter, the present disclosure will be described in detail according to the preferred embodiments with appropriate references to the accompanying drawings.

Unless otherwise described, "a circumferential direction" in the present application means a circumferential direction of a shaft. Unless otherwise described, "a radial direction" in the present application means a radial direction of the shaft. Unless otherwise described, "an axial direction" in the present application means an axial direction of the shaft. Unless otherwise described, "an axial perpendicular direction" in the present application means a direction orthogonally crossing the axial direction of the shaft. Unless otherwise described, a section in the present application means a section along a plane perpendicular to an axis line of the shaft. Unless otherwise described, a grip side in the axial direction of the shaft is defined as an upper side, and a sole side in the axial direction of the shaft is defined as a lower side.

Figure 2:
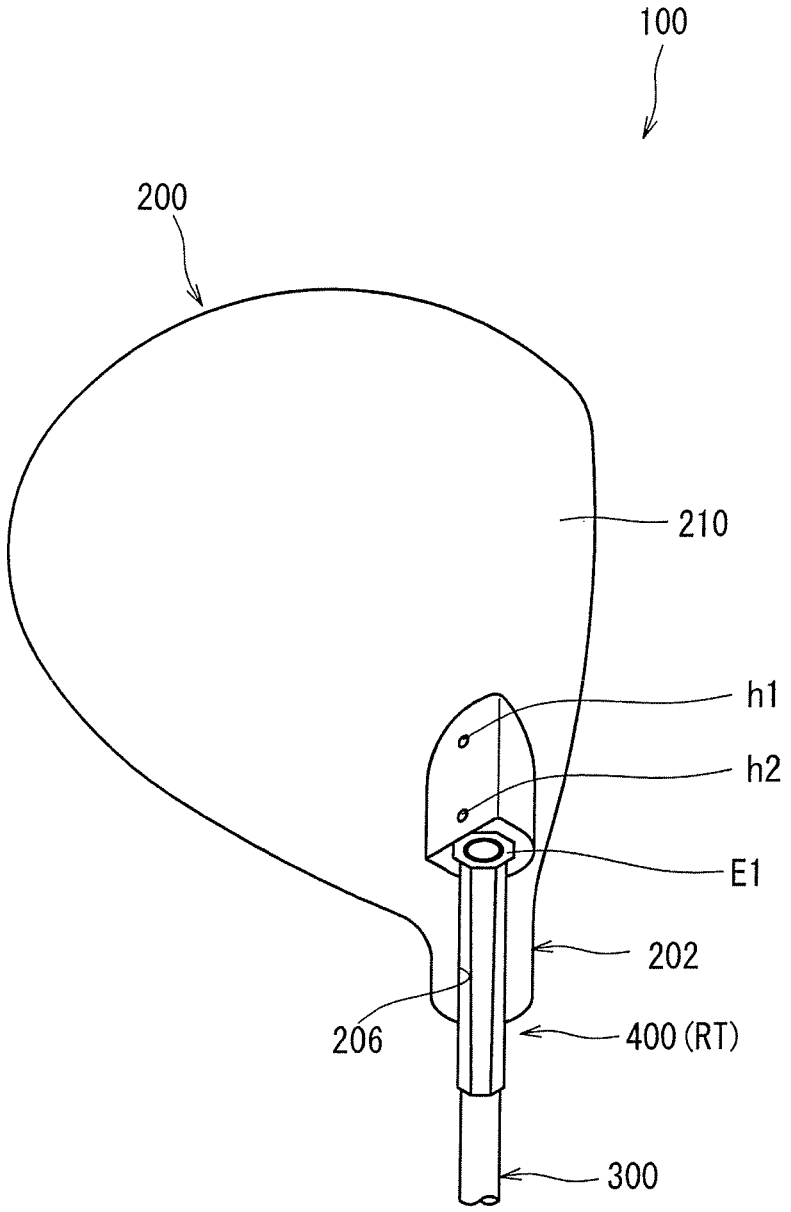
FIG. 2 is a perspective view of the golf club of FIG. 1 as viewed from a sole side.
Figure 3:
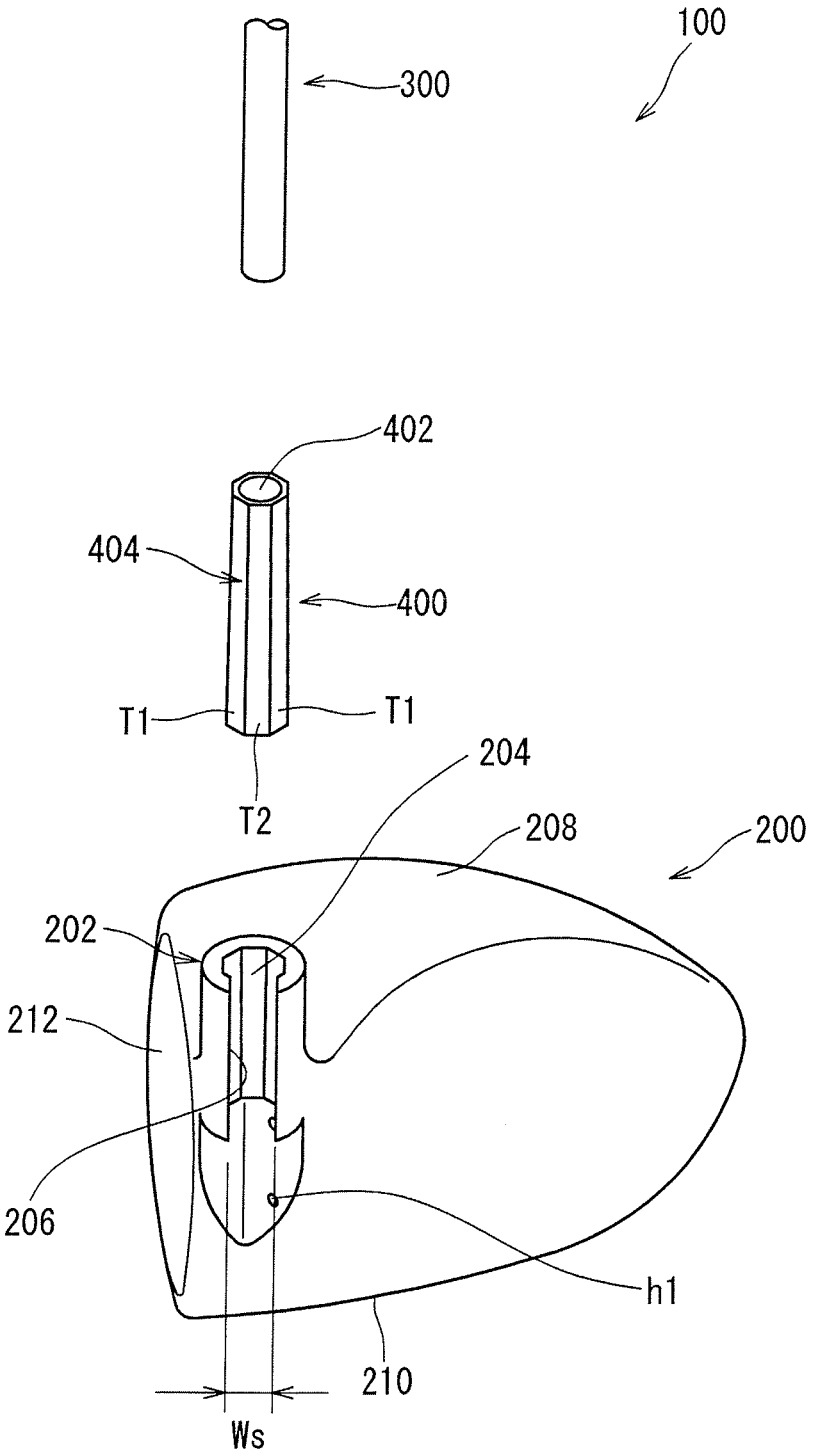
FIG. 3 is an exploded perspective view of the golf club of FIG. 1.

FIG. 1 shows a golf club 100 which is a first embodiment. FIG. 1 shows only the vicinity of a head of the golf club 100. FIG. 2 is a perspective view of the golf club 100 as viewed from a sole side. FIG. 3 is an exploded perspective view of the golf club 100.

The golf club 100 has a head 200, a shaft 300, a sleeve 400, and a grip (not shown). The sleeve 400 constitutes a reverse-tapered engagement part RT. The reverse-tapered engagement part RT is disposed at a tip portion of the shaft 300. An outer surface of the reverse-tapered engagement part RT is formed by the sleeve 400.

The type of the head 200 is not limited. The head 200 of the present embodiment is a wood type head. The head 200 may be a hybrid type head, an iron type head, and a putter head or the like. The wood type head may be a driver head, or may be a head of a fairway wood.

The shaft 300 is not limited, and for example, a carbon shaft and a steel shaft may be used. A commercially available shaft may be used. A tip diameter of the shaft 300 is set so as to correspond to an inner diameter of the sleeve 400.

Although not shown, the diameter of the shaft 300 is changed depending on an axial direction position thereof. The diameter of the shaft 300 is larger as going to the grip side. The tip portion of the shaft 300 is a thinnest portion in the shaft 300.

The golf club 100 according to the first embodiment does not include a spacer (to be described later). Therefore. The reverse-tapered engagement part RT is constituted with the sleeve 400 only. As described later, a spacer may be provided between the sleeve and the head.

The head 200 has a hosel part 202. The hosel part 202 has a hosel hole 204 (see FIG. 3). The hosel hole 204 constitutes a reverse-tapered inner surface. The shape of the reverse-tapered inner surface 204 corresponds to the shape of an outer surface of the reverse-tapered engagement part RT. In other words, the shape of the reverse-tapered inner surface 204 corresponds to the shape of an outer surface of the sleeve 400. In the engagement state, the outer surface of the reverse-tapered engagement part RT (the outer surface of the sleeve 400) is brought into surface-contact with the hosel hole 204. The outer surface of the reverse-tapered engagement part RT has a plurality of (eight) planes, and half (four) of the planes are brought into surface-contact with the hosel hole 204. This is detailed later.

The hosel part 202 has a hosel slit 206. The hosel slit 206 is provided on a side of the hosel part 202. The hosel slit 206 is an opening which communicates between the inside of the hosel hole 204 and the outside of the head. The hosel slit 206 is opened to an axial direction upper side, and is also opened to an axial direction lower side. The hosel slit 206 is provided on the heel side of the hosel part 202. By the hosel slit 206, a part of the reverse-tapered inner surface 204 is lacked. However, the lack does not hinder the holding of the reverse-tapered engagement part Rt.

A width Ws of the hosel slit 206 is shown in FIG. 3. The width Ws is greater than the diameter of the shaft 300. The width Ws is at least greater than the diameter of the thinnest portion of the shaft 300. For this reason, the hosel slit 206 enables the shaft 300 to pass through the hosel slit 206. The hosel slit 206 enables the shaft 300 moving in an axial orthogonal direction to pass through the hosel slit 206. The axial orthogonal direction means a direction orthogonal to the axis line of the shaft 300.

By the hosel slit 206, a part of the hosel hole 204 in the circumferential direction is lacked. From the viewpoint of improving the holding properties of the reverse-tapered engagement part RT, the width Ws is preferably smaller. For example, it is just required that the width Ws is greater than a thinnest portion of an exposed part of the shaft 300 (for example, a portion adjacent to the reverse-tapered engagement part RT). The exposed part of the shaft 300 means a portion to which the sleeve and the grip are not attached and which is exposed to the outside. Needless to say, the width Ws is set so that the reverse-tapered engagement part RT cannot pass through the hosel slit 206. The reverse-tapered engagement part RT cannot pass through the hosel slit 206.

As with a usual head, the head 200 has a crown 208, a sole 210, and a face 212 (see FIGS. 1 to 3).

As shown in FIG. 3, the sleeve 400 has an inner surface 402 and an outer surface 404. The inner surface 402 forms a shaft hole. The sectional shape of the inner surface 402 is a circle. The shape of the inner surface 402 corresponds to an outer surface of the shaft 300. The inner surface 402 is fixed to the tip portion of the shaft 300. That is, the sleeve 400 is fixed to the tip portion of the shaft 300. An adhesive is used for the fixation.

The outer surface 404 is a reverse-tapered outer surface. The outer surface 404 is a pyramid outer surface. The outer surface 404 is an eight-sided pyramid surface. The sectional shape of the outer surface 404 is a non-circle. The sectional shape of the outer surface 404 is a polygon. As described later, the sectional shape of the outer surface 404 is a substantially polygon (substantially regular polygon). The word "substantially" means that a length adjustment mechanism, to be described later, is added. The definition of the word "substantially" is applied to the whole present application.

In the present application, "pyramid surface" means a concept including a pyramid surface (substantially pyramid surface) to which the length adjustment mechanism (to be described later) is added.

The area of a figure (substantially regular polygon) including a sectional line of the reverse-tapered outer surface 404 as an outer edge is larger as approaching a lower side (sole side). That is, the sleeve 400 has a reverse-tapered shape. The figure including the sectional line of the outer surface 404 as the outer edge has the same shape regardless of an axial direction position thereof.

Figure 4:
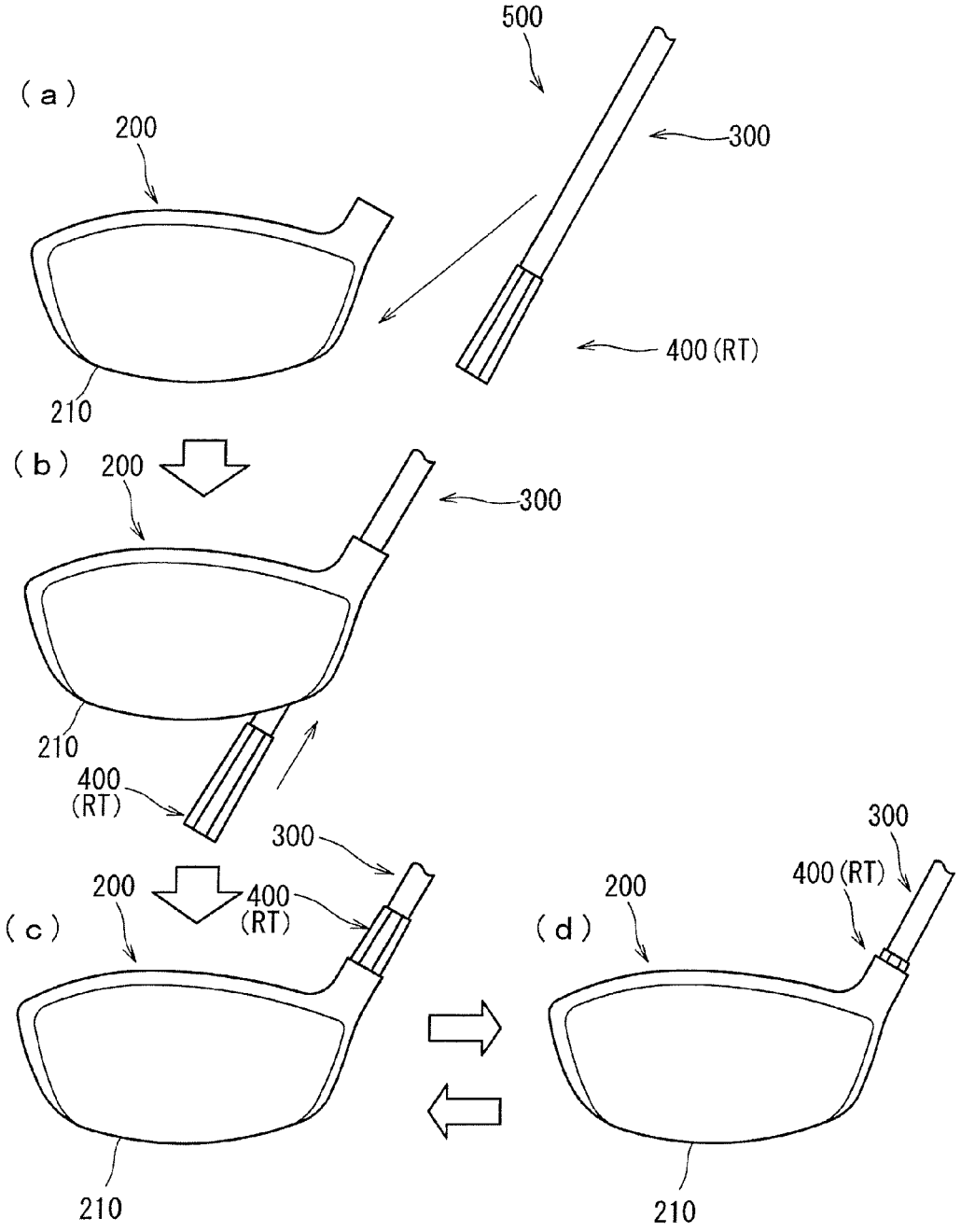
FIG. 4 is an assembling process view of the golf club of FIG. 1.

FIG. 4 shows a procedure of mounting the shaft 300 of the golf club 100 to the head 200.

In the mounting procedure, a shaft assembly 500 is first prepared (symbol (a) in FIG. 4; first step). The shaft assembly 500 has a shaft 300 and a sleeve 400. The sleeve 400 is fixed to a tip portion of the shaft 300, to obtain the shaft assembly 500.

Next, the shaft 300 is made to pass through the hosel slit 206, and the shaft 300 is moved to the inside of a reverse-tapered inner surface 204 (symbol (b) in FIG. 4; second step). As a result of the movement of the shaft 300, the reverse-tapered engagement part RT moves to the sole 210 side of the head 200.

Finally, the shaft 300 (shaft assembly 500) is moved to a grip side along the axial direction, and the reverse-tapered engagement part RT is fitted to the reverse-tapered inner surface 204 (symbol (c) in FIG. 4; third step). The mounting of the shaft 300 to the head 200 is achieved by the fitting. In other words, an engagement state is achieved by the fitting. The engagement state means a state where the reverse-tapered engagement part RT is engaged with the reverse-tapered inner surface 204 to make the golf club 100 usable. In the engagement state, a reverse-tapered fitting is achieved.

Thus, in the golf club 100, the shaft 300 is detachably attached to the head 200. The shaft 300 (shaft assembly 500) is easily attached to the head 200. In addition, the shaft 300 (shaft assembly 500) is also easily detached from the head 200.

Figure 5:
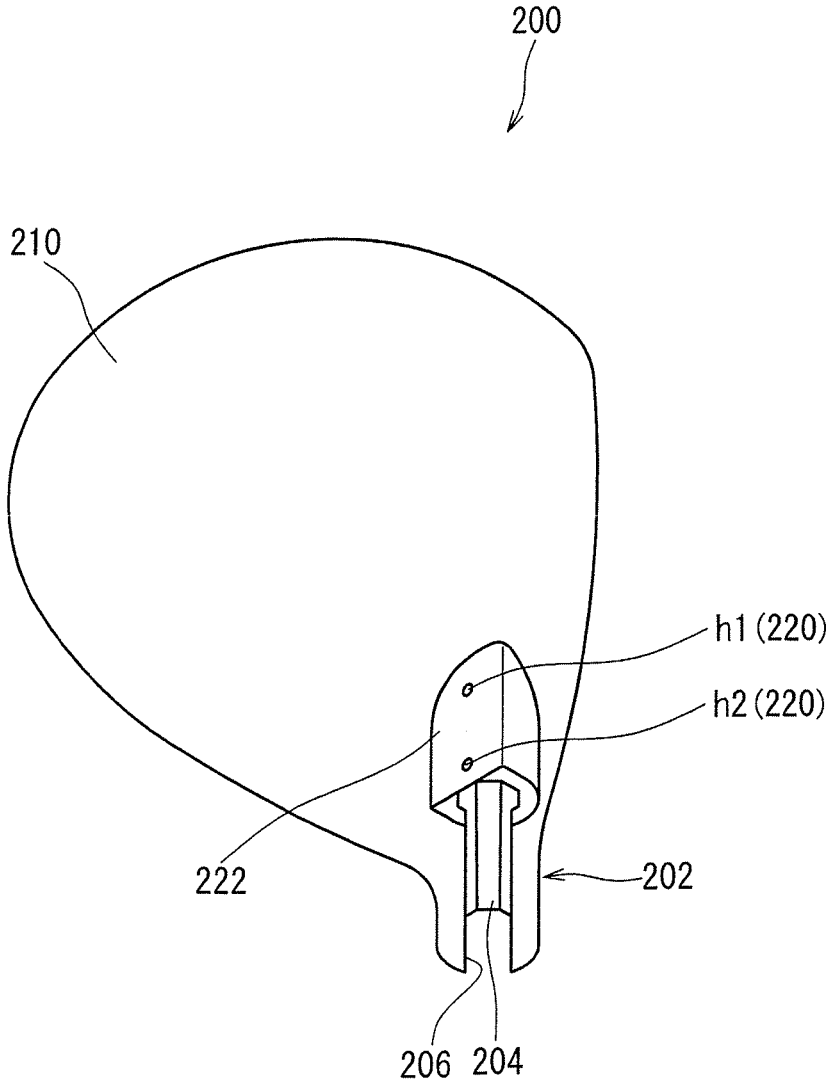
FIG. 5 is a perspective view of a head according to the first embodiment.

FIG. 5 is a perspective view of the head 200 as viewed from a sole side. The head 200 has a falling-off prevention part 220. The falling-off prevention part 220 is provided on an installation surface 222. The installation surface 222 is a surface along the axial direction. The falling-off prevention part 220 can support a bottom surface E1 of the shaft assembly 500 at a plurality of (two) positions. The falling-off prevention part 220 regulates the movement of the reverse-tapered engagement part RT in an engagement releasing direction.

The falling-off prevention part 220 in the present embodiment can support the bottom surface E1 at a plurality of positions. A first screw hole h1 and a second screw hole h2 are provided on the installation surface 222. A falling-off prevention screw (not shown in FIGS. 2 and 5) is screwed to either one of the screw holes h1 and h2. The shaft assembly 500 is prevented from falling off by abutting the falling-off prevention screw (a screw sc1 in FIG. 8 to be described later) on the bottom surface E1 (FIG. 2) of the shaft assembly 500.

In the present application, an engagement releasing direction and an engaging direction are defined. The engagement releasing direction in the present application is a direction along the axial direction, and means a direction where the reverse-tapered engagement part RT moves to a sole side with respect to the reverse-tapered inner surface 204. In other words, the engagement releasing direction means a direction where the reverse-tapered inner surface 204 moves to a grip side with respect to the reverse-tapered engagement part RT. If the reverse-tapered engagement part RT moves in the engagement releasing direction, the reverse-tapered engagement part RT comes out from the reverse-tapered inner surface 204. Meanwhile, the engaging direction in the present application is a direction along the axial direction, and means a direction where the reverse-tapered engagement part RT moves to a grip side with respect to the reverse-tapered inner surface 204. In other words, the engaging direction means a direction where the reverse-tapered inner surface 204 moves to a sole side with respect to the reverse-tapered engagement part RT.

In the golf club 100 in the engagement state, reverse-tapered fitting is formed between the reverse-tapered engagement part RT and the reverse-tapered inner surface 204.

A force in the engaging direction cannot release the reverse-tapered fitting, and increases the contact pressure of the reverse-tapered fitting conversely. The force in the engaging direction further ensures engaging between the reverse-tapered engagement part RT and the reverse-tapered inner surface 204.

A large force acting on the head 200 of the golf club 100 is a centrifugal force during swinging, and an impact shock force at impact. Among these, the centrifugal force is the above-mentioned force in the engaging direction. Due to aloft angle of the head 200, a component force of the impact shock force in the axial direction is also the force in the engaging direction. Therefore, the centrifugal force and the impact shock force cannot release the engaging between the reverse-tapered engagement part RT and the reverse-tapered inner surface 204, and further ensures the engaging conversely. Since the reverse-tapered engagement part RT and the reverse-tapered inner surface 204 have a non-circular sectional shape, relative rotation between the reverse-tapered engagement part RT and the reverse-tapered inner surface 204 cannot occur. As a result, although the reverse-tapered engagement part RT and the reverse-tapered inner surface 204 are not fixed by an adhesive or the like, retention and anti-rotation required as a golf club are achieved. The structure of the reverse-tapered fitting can achieve both holding properties and attaching/detaching easiness.

Therefore, in a hitting (swinging) situation, the falling-off prevention part 200 is not necessarily needed.

Meanwhile, in situations other than swinging, the force in the engagement releasing direction may act on the golf club 100. Examples of the situations include a state where the golf club 100 is inserted into a golf bag. In this state, the golf club 100 is stood with the head 200 up. In this case, the gravity acting on the head 200 acts as the force in the engagement releasing direction. Even if the force in the engagement releasing direction acts under the presence of the falling-off prevention part 220, the head 200 does not fall off.

The force in the engagement releasing direction is smaller than the force in the engaging direction caused by the centrifugal force and the impact shock force or the like. Therefore, a large force does not act on the falling-off prevention part 220. The falling-off prevention part 220 may be a simple mechanism.

Figure 6:
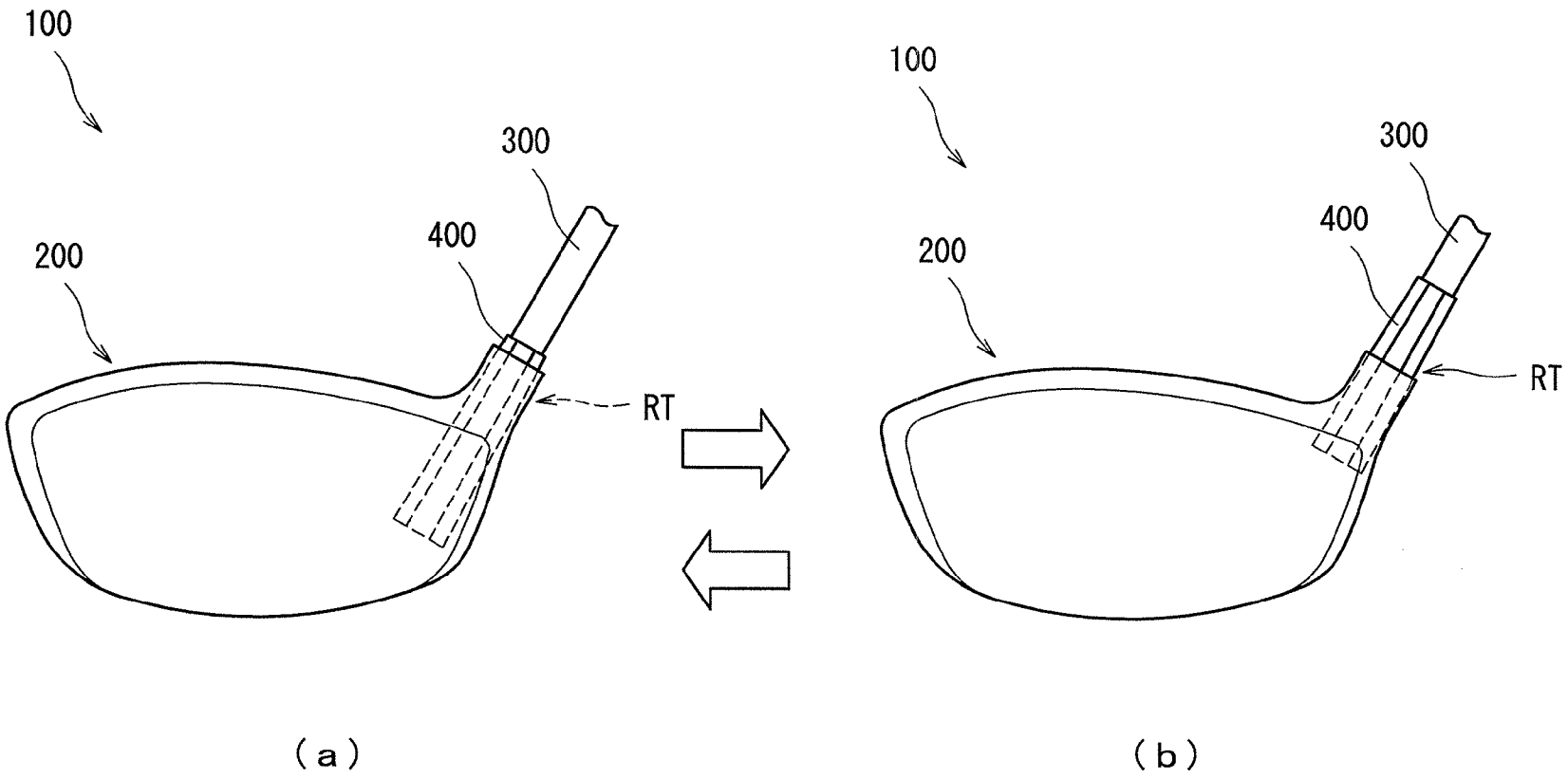
FIG. 6 is an illustrative view showing a mutual shifting between a first state and a second state.

FIG. 6 shows two states of the golf club 100. A symbol (a) in FIG. 6 shows the golf club 100 in a first state. A symbol (b) in FIG. 6 shows the golf club 100 in a second state. The golf club 100 in the first state has a shorter club length than that of the golf club 100 in the second state. Two kinds of lengths can be selected in the golf club 100.

Figure 7:
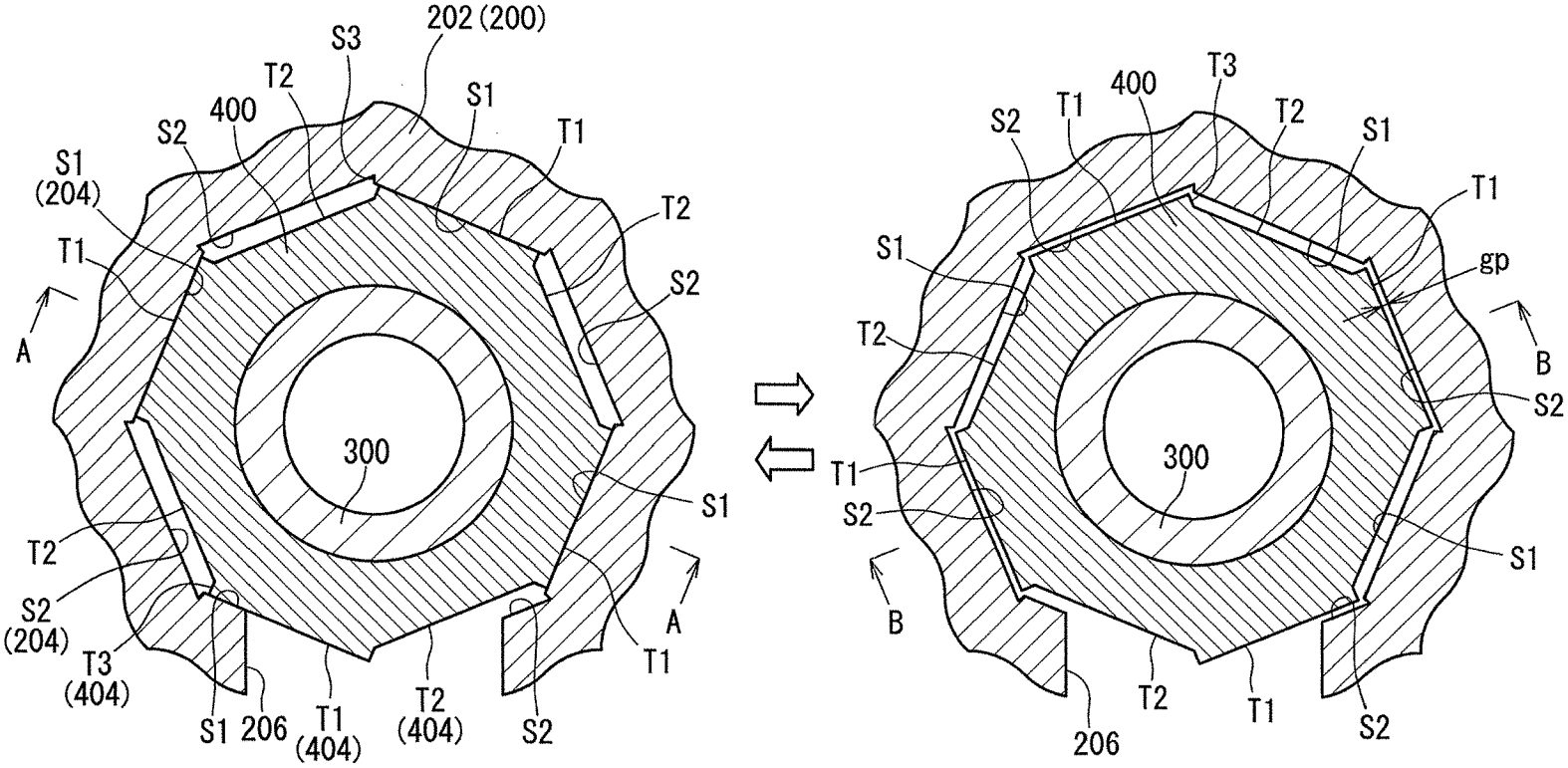
FIG. 7 is sectional views along a radial direction and showing the first state and a shifting state.

FIG. 7 is a sectional view of the golf club 100 at the hosel part 202 and for illustrating the length adjustment mechanism.

A symbol (a) in FIG. 7 is a sectional view in the first state (short state). As shown in the symbol (a) in FIG. 7, the hosel hole (reverse-tapered inner surface) 204 includes a first abutting surface S1 and a second abutting surface S2.

A plurality of (four) first abutting surfaces S1 are provided. A plurality of (four) second abutting surfaces S2 are provided. The first abutting surfaces S1 and the second abutting surfaces S2 are alternately arranged. In the present embodiment, the number of the first abutting surfaces S1 is 4, and the number of the second abutting surfaces S2 is 4. The sum of the number of the first abutting surfaces S1 and the number of the second abutting surfaces S2 is 8.

In the sectional view of the symbol (a) in FIG. 7, respective first abutting surfaces S1 coincide with respective alternate sides of the regular polygon (regular octagon). The regular polygon (regular octagon) coinciding with the first abutting surfaces S1 is defined as a first virtual regular polygon (not shown). In the sectional view of the symbol (a) in FIG. 7, respective second abutting surfaces S2 coincide with respective alternate sides of a regular polygon (regular octagon). The regular polygon (regular octagon) coinciding with the second abutting surfaces S2 is defined as a second virtual regular polygon (not shown).

Radial direction position of the second abutting surfaces S2 is outside with respect to radial direction position of the first abutting surfaces S1. The first virtual regular polygon (virtual regular octagon) is smaller than the second virtual regular polygon (virtual regular octagon). The first virtual regular polygon (virtual regular octagon) and the second virtual regular polygon (virtual regular octagon) have the common central point and the same topology.

Thus, the first abutting surfaces S1 and the second abutting surfaces S2 are alternately arranged along respective sides of a regular polygon (regular octagon), and the radial direction positions of the first abutting surfaces S1 are (slightly) inside of the radial direction positions of the second abutting surfaces S2. A step surface S3 is formed on each boundary between the first abutting surfaces S1 and the second abutting surfaces S2. The step surface S3 may not exist.

As shown in the symbol (a) in FIG. 7, the outer surface 404 of the sleeve 400 includes an abutting engagement surface T1 and a non-abutting engagement surface T2.

A plurality of (four) abutting engagement surfaces T1 are provided. A plurality of (four) non-abutting engagement surfaces T2 are provided. The abutting engagement surfaces T1 and the non-abutting engagement surfaces T2 are alternately arranged. In the present embodiment, the number of the abutting engagement surfaces T1 is 4, and the number of the non-abutting engagement surfaces T2 is 4. The sum of the number of the abutting engagement surfaces T1 and the number of the non-abutting engagement surfaces T2 is 8.

In the sectional view of the symbol (a) in FIG. 7, respective abutting engagement surfaces T1 coincide with respective alternate sides of a regular polygon (regular octagon). The regular polygon (regular octagon) coinciding with the abutting engagement surfaces T1 is defined as a third virtual regular polygon (not shown). In the sectional view of the symbol (a) in FIG. 7, respective non-abutting engagement surfaces T2 coincide with respective alternate sides of a regular polygon (regular octagon). The regular polygon (regular octagon) coinciding with the non-abutting engagement surfaces T2 is defined as a fourth virtual regular polygon (not shown).

Radial direction position of the abutting engagement surfaces T1 is outside with respect to radial direction position of the non-abutting engagement surfaces T2. Therefore, the third virtual regular polygon (virtual regular octagon) is greater than the fourth virtual regular polygon (virtual regular octagon). The third virtual regular polygon (virtual regular octagon) and the fourth virtual regular polygon (virtual regular octagon) have the common central point and the same topology.

Thus, the abutting engagement surfaces T1 and the non-abutting engagement surfaces T2 are alternately arranged along respective sides of a regular polygon (regular octagon), and the radial direction position of the abutting engagement surfaces T1 is (slightly) outside of the radial direction position of the non-abutting engagement surfaces T2. A step surface T3 is formed on each boundary between the abutting engagement surfaces T1 and the non-abutting engagement surfaces T2. The step surface T3 may not exist.

The symbol (a) in FIG. 7 is a sectional view in the first state (a state where the club length is short). In the first state (a), the sleeve 400 (reverse-tapered outer surface 404) is set on a first rotation position.

In the first state (a), the abutting engagement surfaces T1 abut on the respective first abutting surfaces S1. In the first state (a), the abutting engagement surfaces T1 are opposed to the respective first abutting surfaces S1, and the non-abutting engagement surfaces T2 are opposed to the respective second abutting surfaces S2. While the abutting engagement surfaces T1 abut on the respective first abutting surfaces S1, the non-abutting engagement surfaces T2 do not abut on the respective second abutting surfaces S2. A gap is formed each between the non-abutting engagement surfaces T2 and the second abutting surfaces S2.

A symbol (b1) in FIG. 7 is a sectional view showing a shifting state for shifting to the second state. In the symbol (b1) in FIG. 7, the sleeve 400 (reverse-tapered outer surface 404) is set on a second rotation position.

The shifting state (b1) means a state in which the sleeve 400 (shaft assembly 500) is rotated by a predetermined angle θ (45 degrees) without changing the axial direction position of the sleeve 400 with respect to the hosel part 202. The shifting state (b1) is described in order to facilitate the understanding of the length adjustment mechanism. When the rotation of the predetermined angle θ is actually performed, the rotation can be made after once moving the reverse-tapered engagement part RT in the engagement releasing direction. The rotation position of the sleeve 400 (reverse-tapered outer surface 404) is shifted to the second rotation position from the first rotation position by rotating the sleeve 400 (reverse-tapered outer surface 404) by the predetermined angle θ.

In the shifting state (b1), the abutting engagement surfaces T1 are opposed to the respective second abutting surfaces S2, and the non-abutting engagement surfaces T2 are opposed to the respective first abutting surfaces S1. In this state, the abutting engagement surfaces T1 do not abut on the respective second abutting surfaces S2. As a matter of course, the non-abutting engagement surfaces T2 do not abut on the respective first abutting surfaces S1, either. A width of each gap gp between the abutting engagement surface T1 and the second abutting surface S2 is smaller than a width of each gap between the non-abutting engagement surface T2 and the first abutting surface S1.

The fact that the abutting engagement surfaces T1 do not abut on the respective second abutting surfaces S2 in the shifting state (b1) of FIG. 7 shows the feasibility of two kinds of club lengths. That is, the gap gp realizes a second club length (greater club length). This point is explained below by using FIG. 8.

Figure 8:
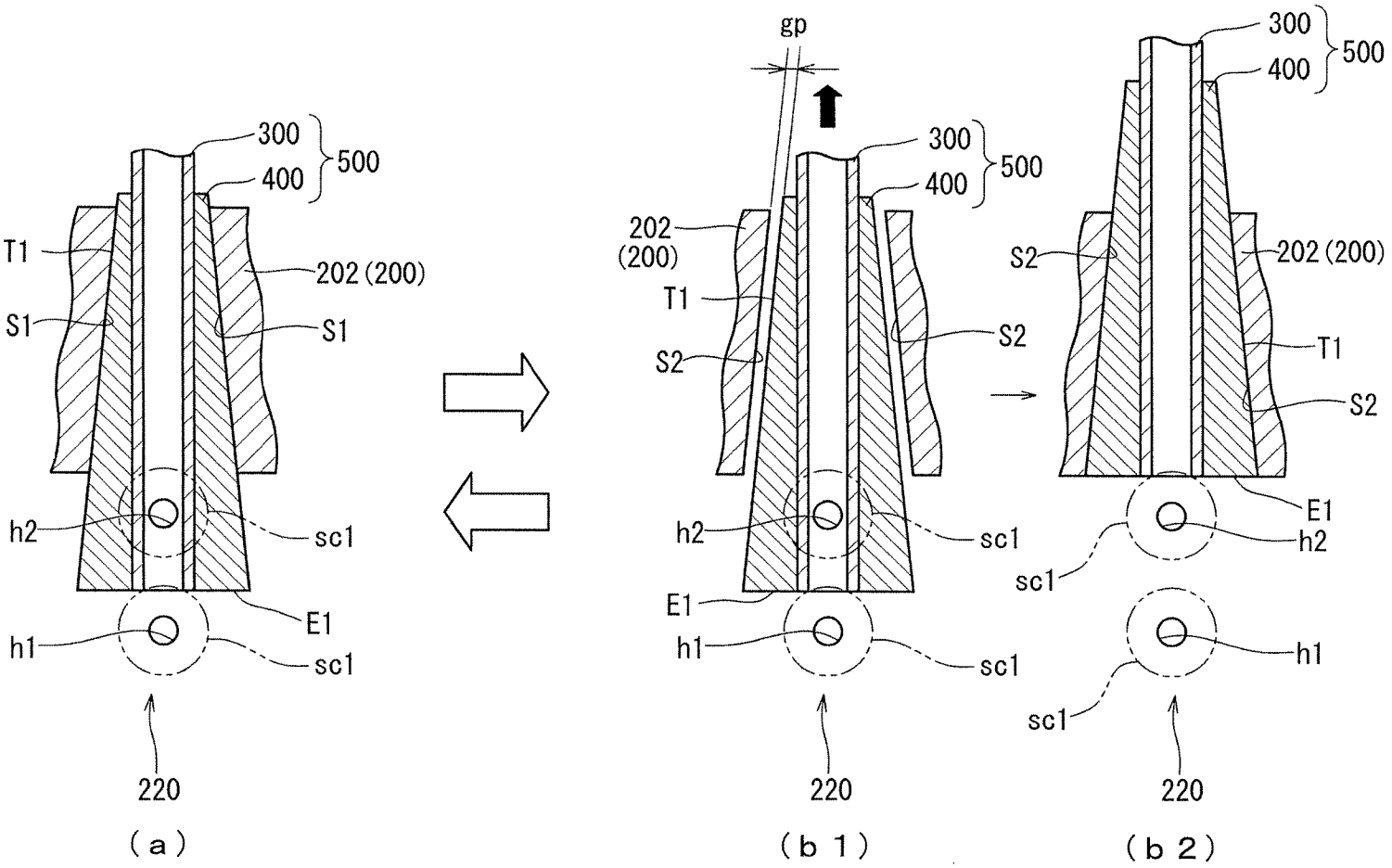
FIG. 8 is sectional views along an axial direction and showing the first state, the shifting state and the second state.

A symbol (a) in FIG. 8 is a sectional view taken along line A-A of the symbol (a) in FIG. 7. A symbol (b1) in FIG. 8 is a sectional view taken along line B-B in the symbol (b1) in FIG. 7. As also shown in the symbol (b1) in FIG. 8, in the shifting state, a gap gp exists at each of between the abutting engagement surfaces T1 and the respective second abutting surfaces S2. For eliminating the gap to abut the abutting engagement surfaces T1 on the respective second abutting surfaces S2, the shaft assembly 500 (reverse-tapered engagement part RT) should be moved to axial-direction upper side. That is, the abutting engagement surfaces T1 abut on the respective second abutting surfaces S2 by moving the shaft assembly 500 to the axial-direction upper side with respect to the hosel part 202. As a result, the second state is realized. The symbol (b2) in FIG. 8 shows the second state.

As described above, the axial direction position of the reverse-tapered outer surface 404 with respect to the reverse-tapered inner surface 204 in the first state is different from that of the second state. The first state (a) in which the club length is short and the second state (b2) in which the club length is long are realized by the difference. In the golf club 100, a mutual shifting between the first state and the second state is enabled by rotating the reverse-tapered engagement part RT with respect to the reverse-tapered inner surface 204.

As shown in FIG. 8, the falling-off prevention part 220 includes a plurality of screw holes h1 and h2, and a screw sc1 capable of being screwed to the screw holes h1 and h2. A plan view of the head part of the screw sc1 is shown by using two-dot chain lines in FIG. 8. The head part of the screw sc1 abuts on the lower end surface E1 of the shaft assembly 500. As shown in the symbol (a) in FIG. 8, in the first state in which the club is short, the screw sc1 is screwed to the first screw hole h1 and abuts on the lower end surface E1 in the first state. As shown in the symbol (b2) in FIG. 8, in the second state in which the club is long, the screw sc1 is screwed to the second screw hole h2 and abuts on the lower end surface E1 in the second state. Thus, the falling-off prevention part 220 can support the lower end surface E1 of the shaft assembly 500 at a plurality of axial direction positions.

Figure 9:
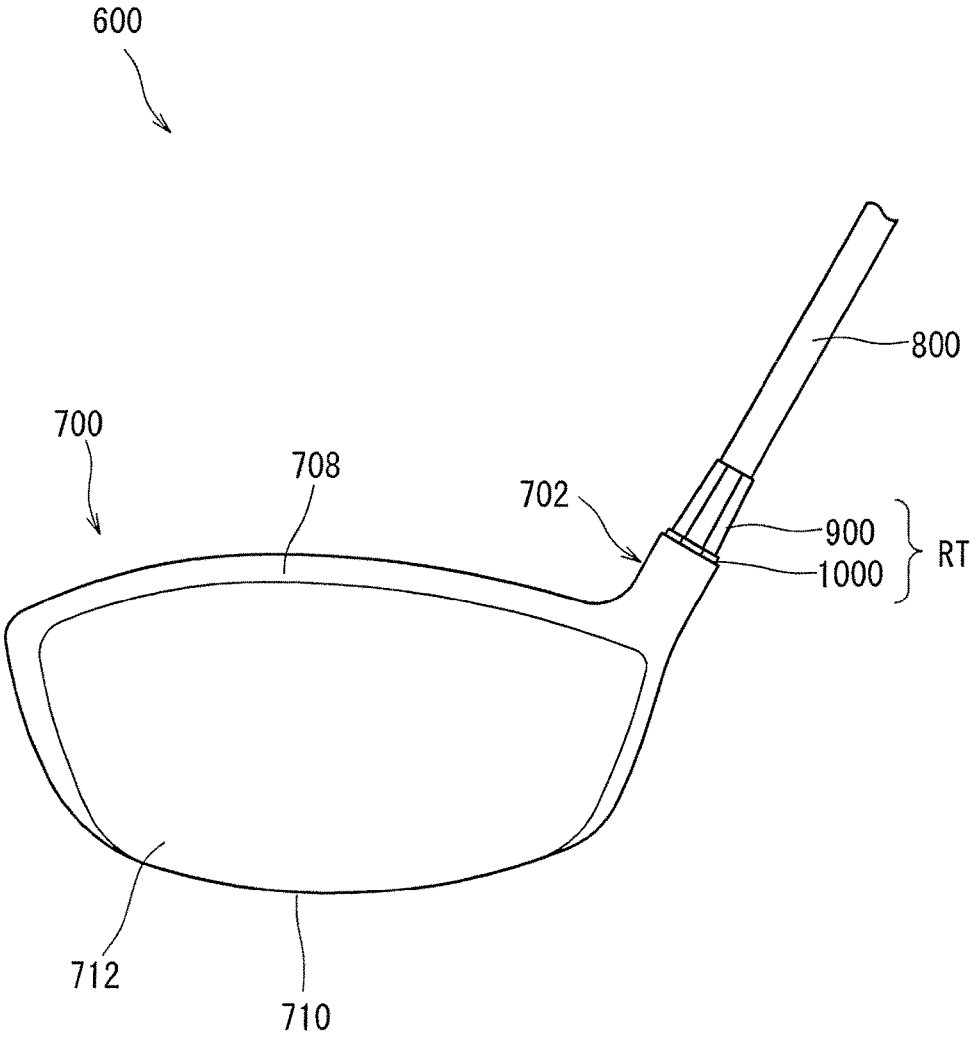
FIG. 9 is a front view of a golf club according to a second embodiment.
Figure 10:
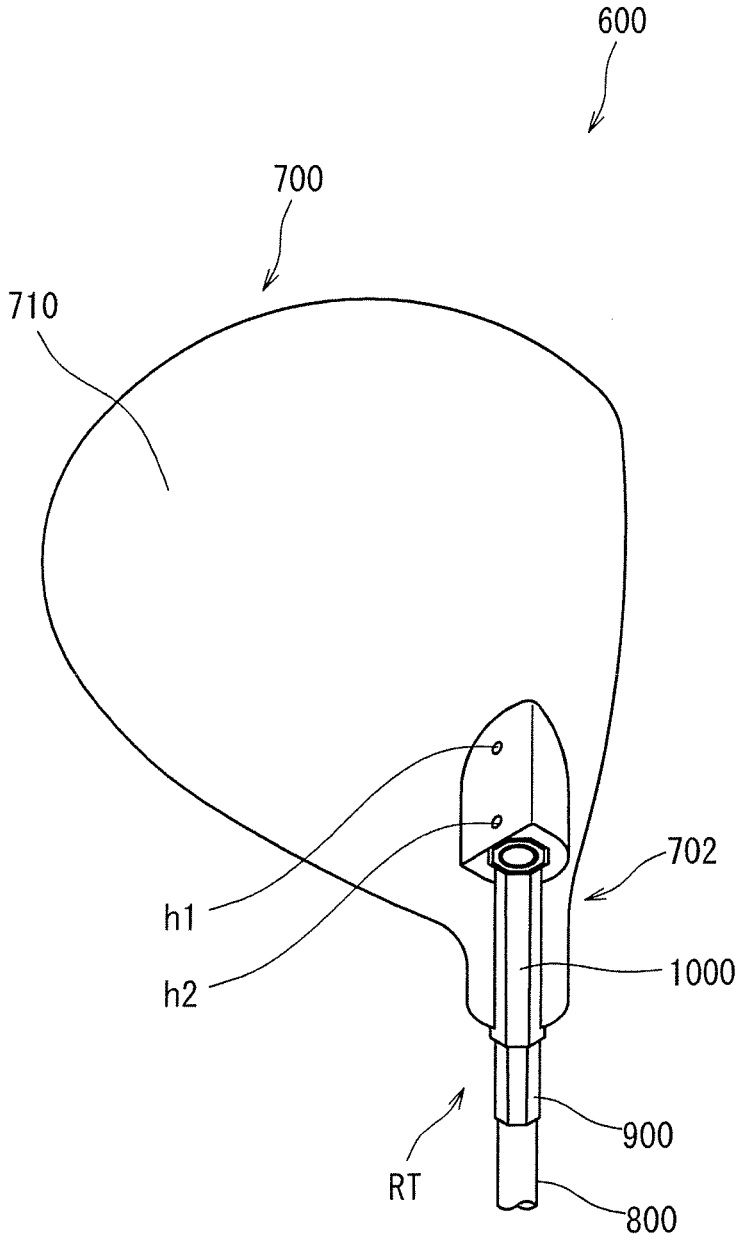
FIG. 10 is a perspective view of the golf club of FIG. 9 as viewed from a sole side.
Figure 11:
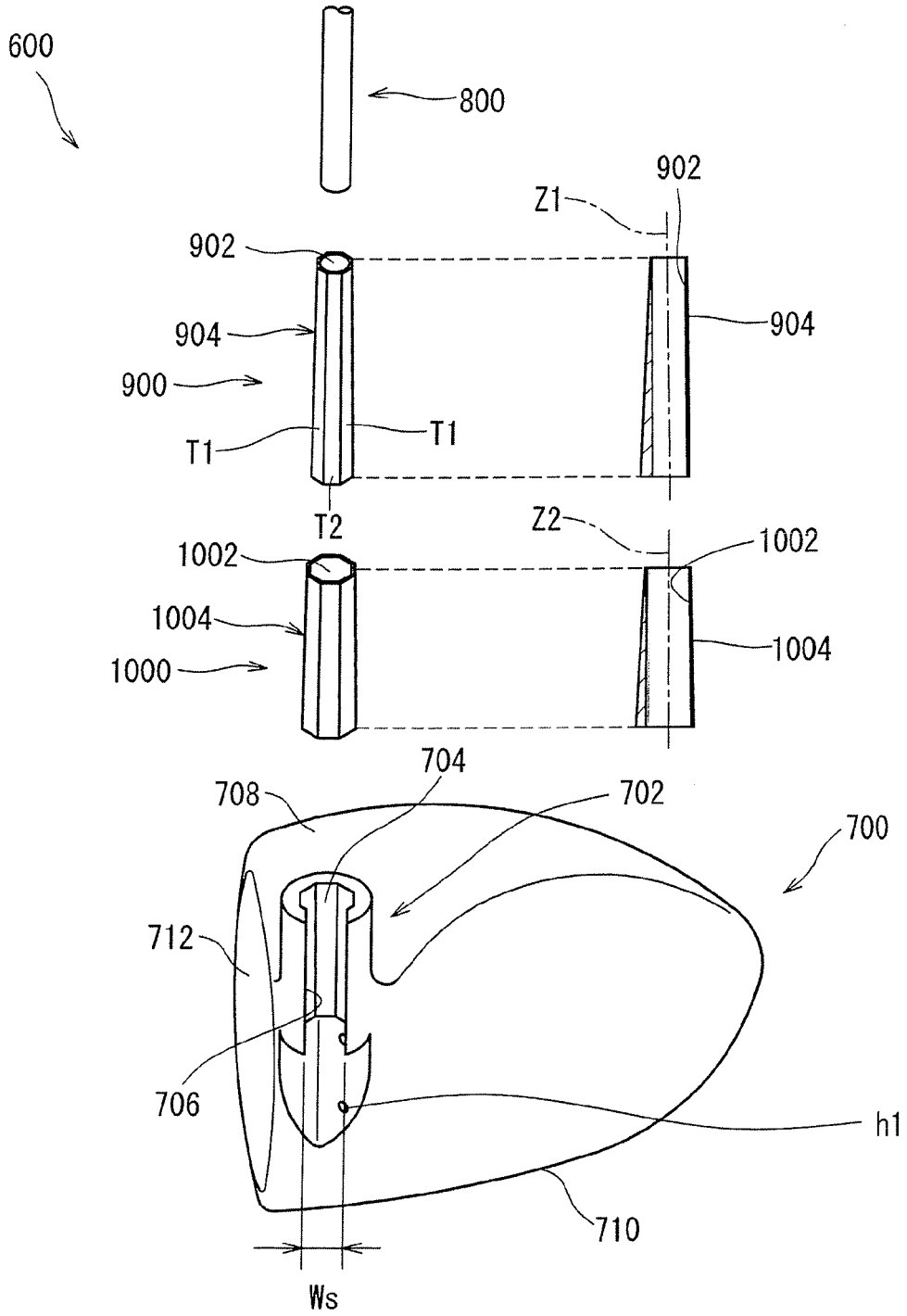
FIG. 11 is an exploded perspective view of the golf club of FIG. 9.

FIG. 9 shows a golf club 600 of a second embodiment. FIG. 9 shows only the vicinity of a head of the golf club 600. FIG. 10 is a perspective view of the golf club 600 as viewed from the sole side. FIG. 11 is an exploded perspective view of the golf club 600.

The golf club 600 has a head 700, a shaft 800, a sleeve 900, a spacer 1000, and a grip (not shown). The sleeve 900 and the spacer 1000 constitute a reverse-tapered engagement part RT. The reverse-tapered engagement part RT is disposed at a tip portion of the shaft 800. An outer surface of the reverse-tapered engagement part RT is formed by the spacer 1000.

In the above-mentioned golf club 100, the spacer is not provided. On the other hand, the spacer 1000 is provided in the golf club 600. The number of spacers 1000 is one. Two or more spacers 1000 may be provided.

The type of the head 700 is not limited. The head 700 of the present embodiment is a wood type head. The head 700 may be a hybrid type head, an iron type head, and a putter head or the like. The wood type head may be a driver head, or may be a head of a fairway wood.

The shaft 800 is not limited, and for example, a carbon shaft and a steel shaft may be used. A commercially available shaft may be used. A tip diameter of the shaft 800 is set so as to correspond to an inner diameter of the sleeve 900.

Although not shown, the diameter of the shaft 800 is changed depending on an axial direction position. The diameter of the shaft 800 is larger as going to the grip side. The spacer 1000 is disposed outside the sleeve 900 fixed to the tip portion of the shaft 800. The tip portion of the shaft 800 is a thinnest portion in the shaft 800.

The head 700 has a hosel part 702. The hosel part 702 has a hosel hole 704 (see FIG. 11). The shape of the hosel hole (reverse-tapered inner surface) 704 corresponds to the shape of an outer surface of the reverse-tapered engagement part RT. In other words, the shape of the hosel hole (reverse-tapered inner surface) 704 corresponds to the shape of an outer surface of the spacer 1000. In the engagement state, the outer surface of the reverse-tapered engagement part RT (the outer surface of the spacer 1000) is brought into surface-contact with the hosel hole 704. The outer surface of the reverse-tapered engagement part RT has a plurality of (eight) planes, and half (four) of the planes are brought into surface-contact with the hosel hole 704.

The hosel part 702 has a hosel slit 706. The hosel slit 706 is provided on a side of the hosel part 702. The hosel slit 706 is an opening which communicates between the inside of the hosel hole 704 and the outside of the head. The hosel slit 706 is opened to an axial direction upper side, and is also opened to an axial direction lower side. The hosel slit 706 is provided on the heel side of the hosel part 702. By the hosel slit 706, a part of the reverse-tapered inner surface 704 is lacked. However, the lack does not hinder the holding of the reverse-tapered engagement part Rt.

A width Ws of the hosel slit 706 is shown in FIG. 11. The width Ws is greater than the diameter of the shaft 800. The width Ws is at least greater than the diameter of the thinnest portion of the shaft 800. For this reason, the hosel slit 706 enables the shaft 800 to pass through the hosel slit 706. The hosel slit 706 enables the shaft 800 moving in an axial orthogonal direction to pass through the hosel slit 706.

By the hosel slit 706, a part of the hosel hole 704 in the circumferential direction is lacked. From the viewpoint of improving the holding properties of the reverse-tapered engagement part RT, the width Ws is preferably smaller. For example, it is just required that the width Ws is greater than a thinnest portion of an exposed part of the shaft 800 (for example, a portion adjacent to the reverse-tapered engagement part RT). The exposed part of the shaft 800 means a portion to which the sleeve and the grip are not attached and which is exposed to the outside. Needless to say, the width Ws is set so that the reverse-tapered engagement part RT cannot pass through the hosel slit 706. The reverse-tapered engagement part RT cannot pass through the hosel slit 706.

As with a usual head, the head 700 has a crown 708, a sole 710, and a face 712 (see FIGS. 9 to 11).

As shown in FIG. 11, the sleeve 900 has an inner surface 902 and an outer surface 904. The inner surface 902 forms a shaft hole. The sectional shape of the inner surface 902 is a circle. The shape of the inner surface 902 corresponds to an outer surface of the shaft 800. The inner surface 902 is fixed to the tip portion of the shaft 800. That is, the sleeve 900 is fixed to the tip portion of the shaft 800. An adhesive is used for the fixation.

The outer surface 904 of the sleeve 900 is a reverse-tapered outer surface. The outer surface 904 is a pyramid outer surface. The outer surface 904 is an eight-sided pyramid surface. The sectional shape of the outer surface 904 is a non-circle. The sectional shape of the outer surface 904 is a polygon. As described later, the sectional shape of the outer surface 904 is a substantially regular polygon. The word "substantially" means that the length adjustable shape as described above is added.

The area of a figure (substantially regular polygon) including a sectional line of the reverse-tapered outer surface 904 as an outer edge is larger as approaching a lower side (sole side). That is, the sleeve 900 has a reverse-tapered shape. The figure including the sectional line of the outer surface 904 as the outer edge has the same shape regardless of an axial direction position thereof.

A sectional view of the sleeve 900 is supplementary depicted in FIG. 11. As shown in the sectional view, an axis line of the inner surface 902 is inclined with respect to an axis line of the outer surface 904.

As shown in FIG. 11, the spacer 1000 has an inner surface 1002 and an outer surface 1004. The inner surface 1002 is a reverse-tapered inner surface, although it is difficult to recognize the fact from FIG. 11. The sectional shape of the inner surface 1002 corresponds to the sectional shape of the outer surface 904 of the sleeve 900. The spacer 1000 is externally fitted to the sleeve 900. The spacer 1000 is not bonded to the sleeve 900. The spacer 1000 is merely brought into contact with the sleeve 900.

The shape of the outer surface 1004 of the spacer 1000 is a reverse-tapered outer surface. The outer surface 1004 is a pyramid outer surface. The outer surface 1004 is an eight-sided pyramid surface. The sectional shape of the outer surface 1004 is a non-circle. The sectional shape of the outer surface 1004 is a polygon. As described later, the sectional shape of the outer surface 1004 is a substantially regular polygon.

The sectional shape of the spacer 1000 is supplementary depicted in FIG. 11. As shown in the sectional view, an axis line Z2 of the inner surface 1002 is inclined with respect to an axis line of the outer surface 1004.

In the present embodiment, the axial direction length of the sleeve 900 is greater than the axial direction length of the spacer 1000.

Figure 12:
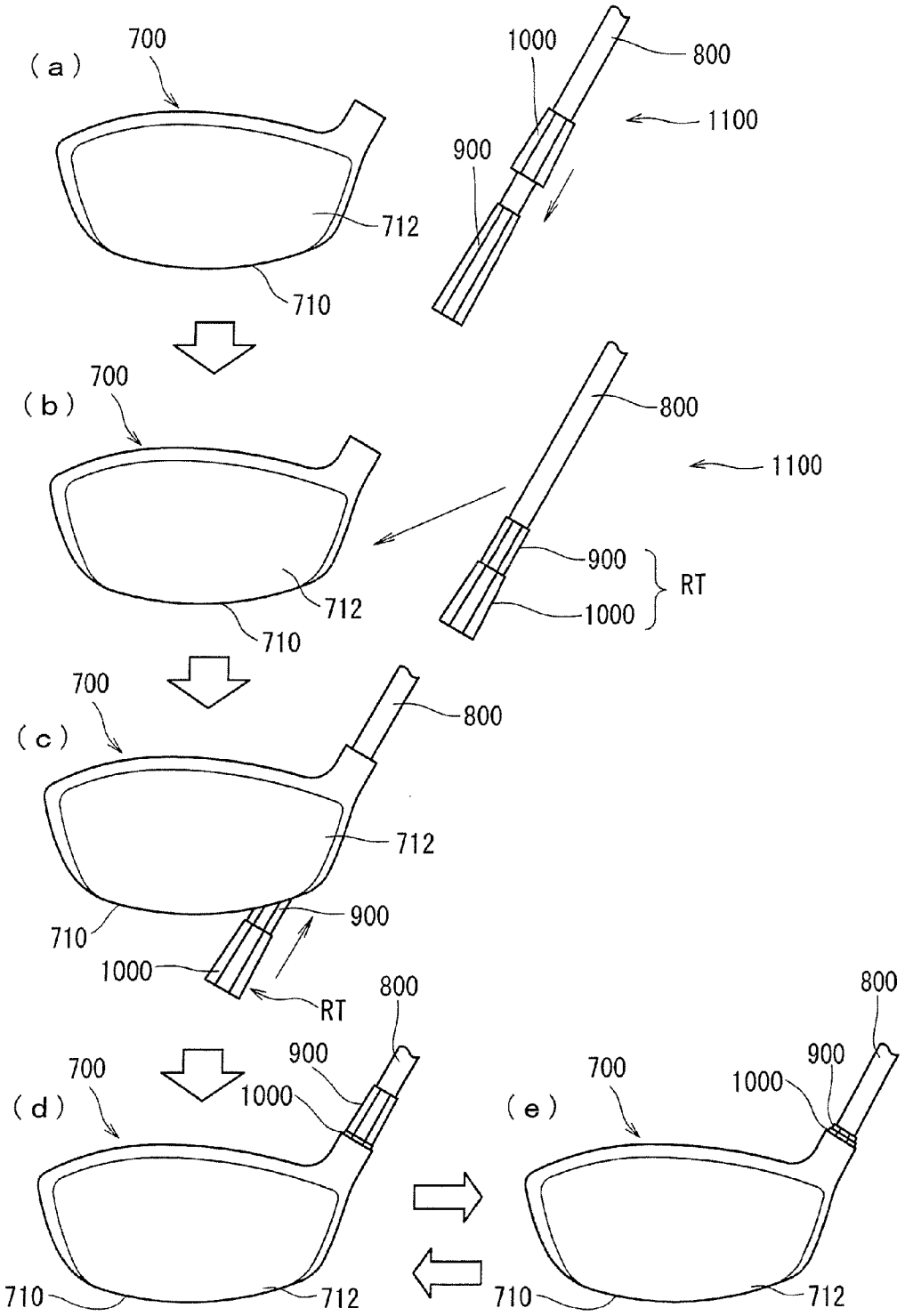
FIG. 12 is an assembling process view of the golf club of FIG. 9.

FIG. 12 is a figure for illustrating a procedure of mounting the shaft 800 to the head 700.

In the mounting procedure, a shaft assembly 1100 is first prepared (symbol (a) in FIG. 12; first step). The shaft assembly 1100 has a shaft 800, a sleeve 900, and a spacer 1000. After the shaft 900 is inserted into the spacer 1000, the sleeve 900 is fixed to a tip portion of the shaft 800, to obtain the shaft assembly 1100. In the shaft assembly 1100, the sleeve 900 is fixed to the shaft 800, but the spacer 1000 is not fixed to the shaft 800. The spacer 1000 can move in an axial direction in a state where the shaft 800 is inserted into the spacer 1000 (see symbol (a) in FIG. 12). However, the spacer 1000 does not fall off from the shaft 800 under the presence of the sleeve 900.

Next, in the shaft assembly 1100, the spacer 1000 is moved until the spacer 1000 abuts on an outer surface of the sleeve 900 (symbol (b) in FIG. 12; second step). That is, the spacer 1000 is moved to the forefront side of the shaft assembly 1100. By the movement, the spacer 1000 is engaged with the sleeve 900 to complete a reverse-tapered engagement part RT.

Next, the shaft 800 is made to pass through the hosel slit 706, and the shaft 800 is moved into a reverse-tapered inner surface 704 (symbol (c) in FIG. 12; third step). As a result of the movement of the shaft 800, the reverse-tapered engagement part RT moves to the sole 710 side of the head 700.

Finally, the shaft 800 (shaft assembly 1100) is moved to a grip side along the axial direction, and the reverse-tapered engagement part RT is fitted to the reverse-tapered inner surface 704 (symbol (d) in FIG. 12; fourth step). The mounting of the shaft 800 to the head 700 is achieved by the fitting. In other words, an engagement state is achieved by the fitting. The engagement state is a state where the golf club 600 can be used. In the engagement state, all reverse-tapered fittings are achieved. That is, a reverse-tapered fitting is achieved between the reverse-tapered outer surface 904 of the sleeve 900 and the reverse-tapered inner surface 1002 of the spacer 1000, and a reverse-tapered fitting is achieved between the reverse-tapered outer surface 1004 of the spacer 1000 and the reverse-tapered inner surface 704 of the hosel 702.

Thus, the shaft 800 (shaft assembly 1100) is easily attached to the head 700. In addition, the shaft 800 (shaft assembly 1100) is also easily detached from the head 700. In the golf club 600, the shaft 800 is detachably attached to the head 700.

In the first embodiment, a spacer is not provided, and the length adjustment mechanism is formed by a structure between the reverse-tapered inner surface 204 of the hosel part 202 and the reverse-tapered outer surface 404 of the sleeve 400. On the other hand, in the second embodiment, the length adjustment mechanism is formed by a structure between the reverse-tapered inner surface 1002 of the spacer 1000 and the reverse-tapered outer surface 904 of the sleeve 900. The sectional shape of the reverse-tapered inner surface 1002 is the same as that of the reverse-tapered inner surface 204 as described above. The sectional shape of the reverse-tapered outer surface 904 is the same as that of the reverse-tapered outer surface 404 as described above. The length adjustment mechanism enables a mutual shifting between the first state (symbol (e) in FIG. 12) in which the club length is short and the second state (symbol (d) in FIG. 12) in which the club length is long. The club length is changed by moving the position of the sleeve 900 (shaft assembly 1100) in the axial direction without changing the position of the spacer 1000.

Figure 13:
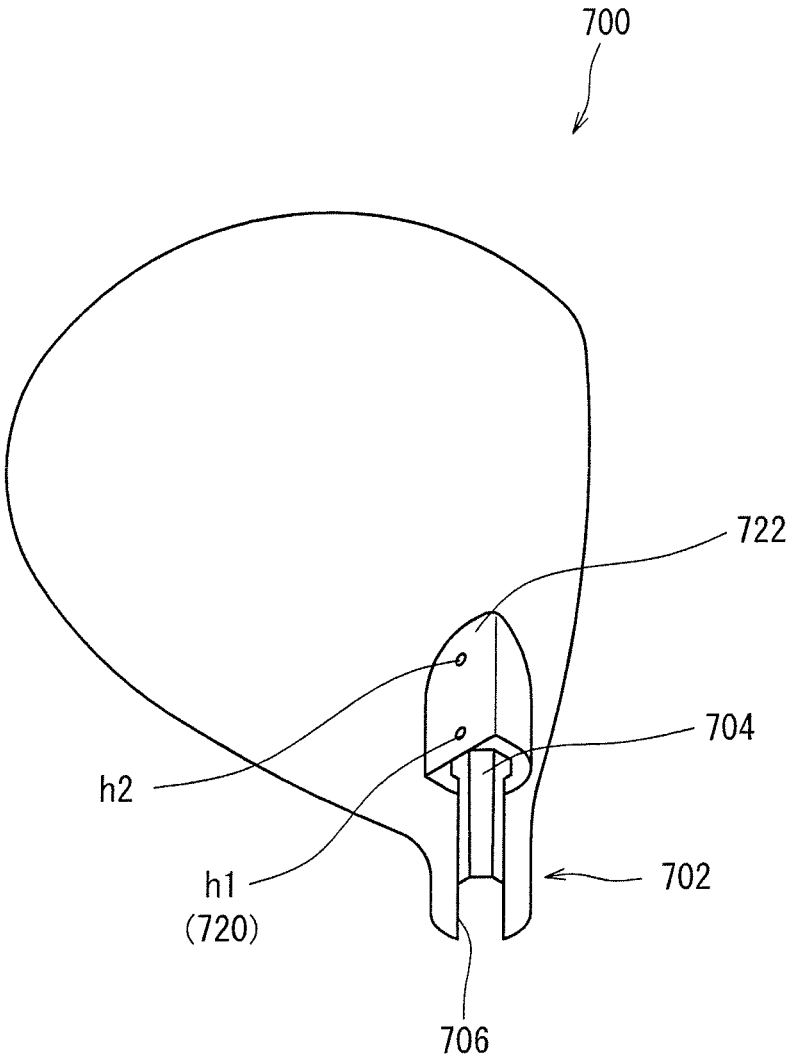
FIG. 13 is a perspective view of a head according to the second embodiment.

FIG. 13 is a perspective view of the head 700 as viewed from the sole side. The head 700 has a falling-off prevention part 720. The falling-off prevention part 720 is provided on an installation surface 722. The installation surface 722 is a surface along the axial direction. A first screw hole h1 and a second screw hole h2 are provided on the installation surface 722. The falling-off prevention part 720 is constituted with the screw holes h1, h2 and a screw sc1 (see FIG. 8). The constitution and function of the falling-off prevention part 720 are the same as those of the falling-off prevention part 220 as described above.

As described above, in both the first embodiment and the second embodiment, a length adjustment mechanism is formed between the reverse-tapered outer surface and the reverse-tapered inner surface.

In the first embodiment in which a spacer does not exist, the length adjustment mechanism is formed between the reverse-tapered outer surface 404 of the sleeve 400 (reverse-tapered engagement part RT) and the reverse-tapered inner surface 204 of the hosel part 202.

In the second embodiment in which the number of spacers is one, the length adjustment mechanism is formed by a structure between the reverse-tapered outer surface 904 of the sleeve 900 and the reverse-tapered inner surface 1002 of the spacer 1000. Of course, in the second embodiment, a length adjustment mechanism may be formed between the reverse-tapered outer surface 1004 of the spacer 1000 and the reverse-tapered inner surface 704 of the hosel part 702. If two length adjustment mechanisms are provided, the degree of freedom of adjustment of club length is enhanced.

When the number of spacers is two or more, more length adjustment mechanisms can be provided. For example, the number of spacers is 2, the length adjustment mechanism can be provided on one or more positions selected from the following (1) to (3): (1) between the sleeve and an inner spacer; (2) between the inner spacer and an outer spacer; and (3) between the outer spacer and the hosel hole.

That is, the length adjustment mechanism can be formed at every between abutting surfaces in which the reverse-tapered outer surface and the reverse-tapered inner surface constitute the reverse-tapered fitting. As described above, in light of the degree of freedom of adjustment of club length, the number of length adjustment mechanisms is preferably greater, and for example, two or three length adjustment mechanisms are provided. In light of avoiding complexity of the constitution, the number of length adjustment mechanisms is preferably 1 or 2, and more preferably 1.

Figure 14:
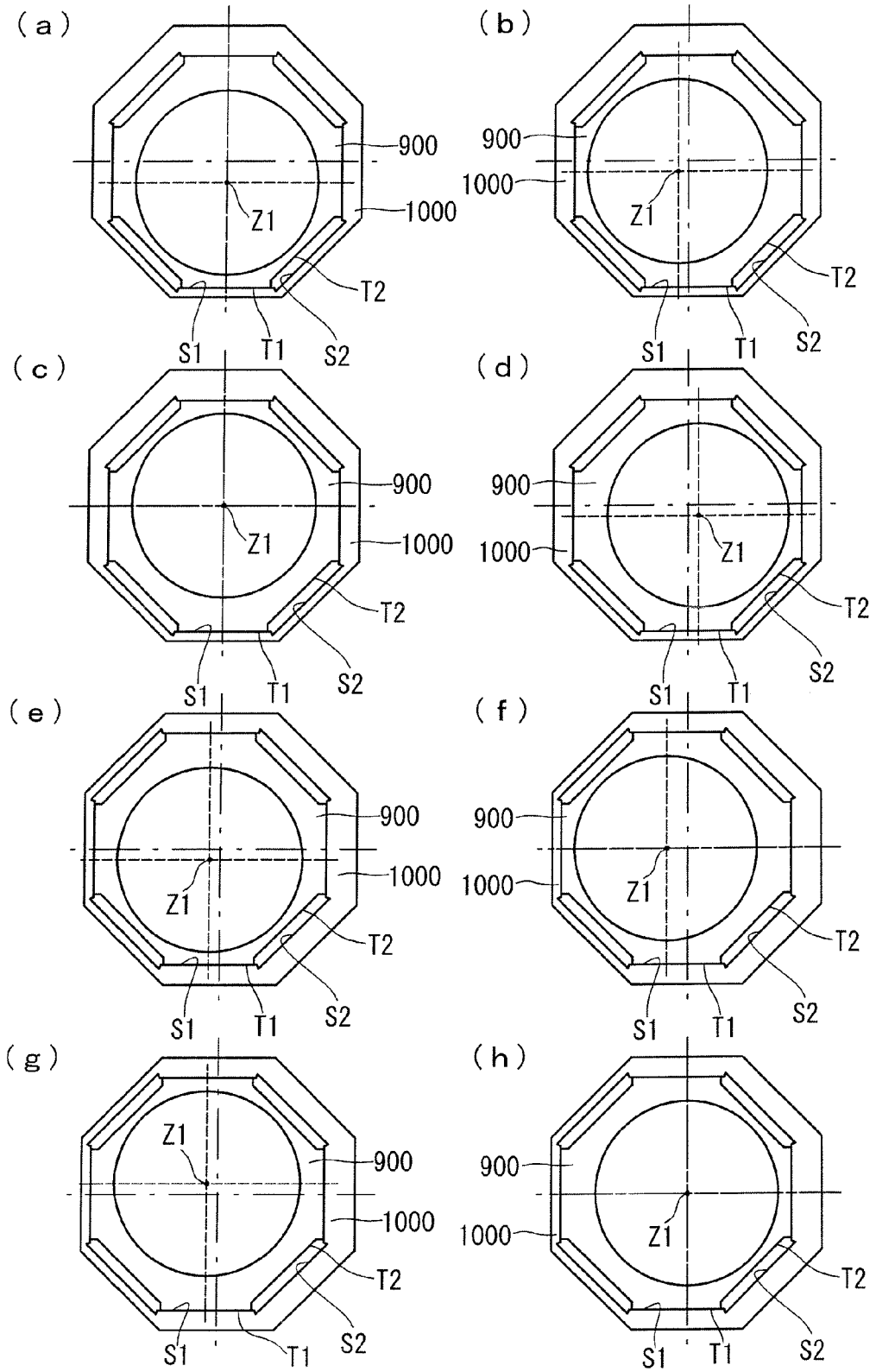
FIG. 14 is bottom views of a lower end face of a shaft, and showing variation in the positions of an axis line of the shaft in the second embodiment.
Figure 15:
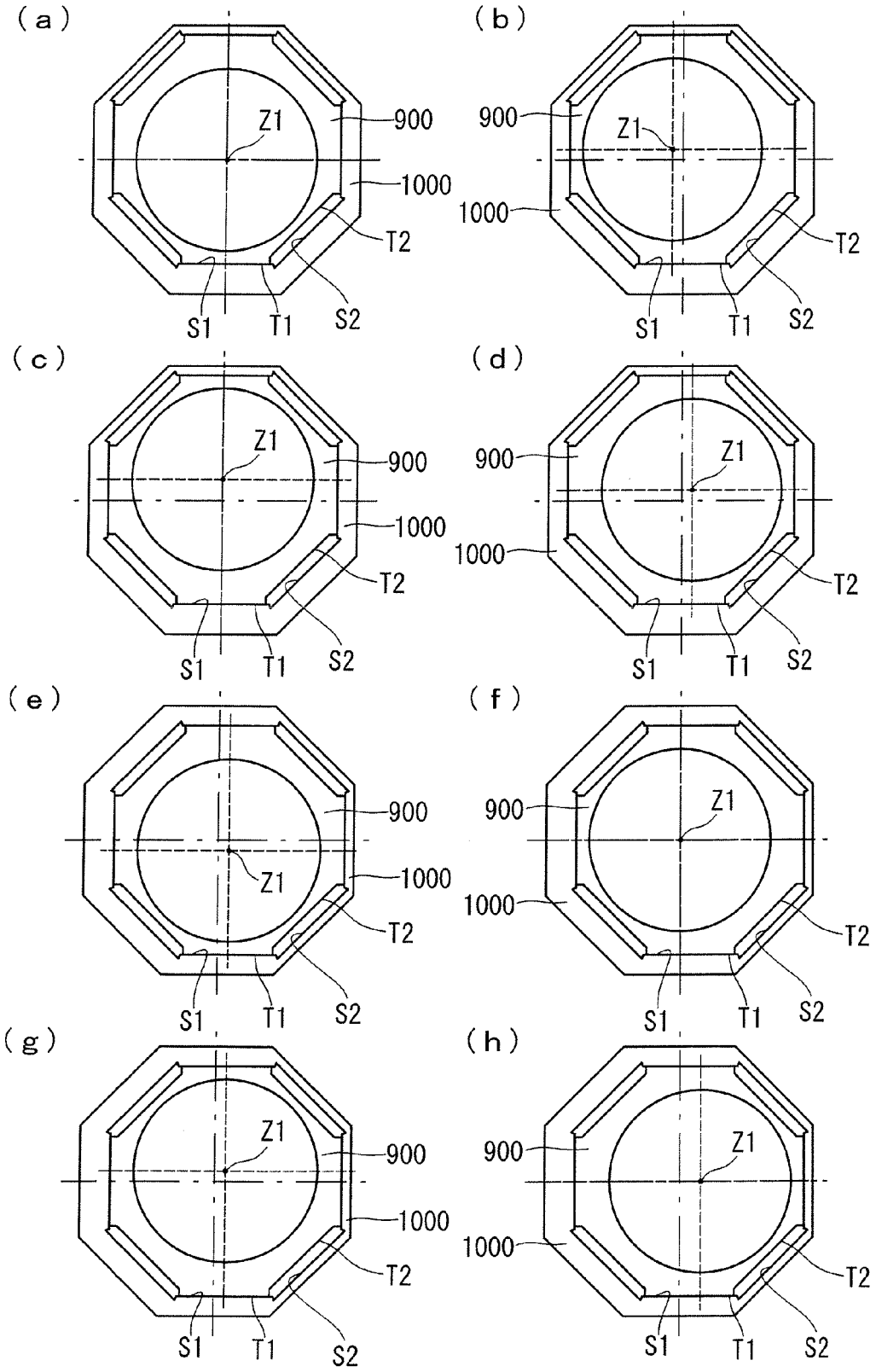
FIG. 15 is also bottom views of the lower end face of the shaft, and showing variation in the positions of the axis line of the shaft in the second embodiment.
Figure 16:
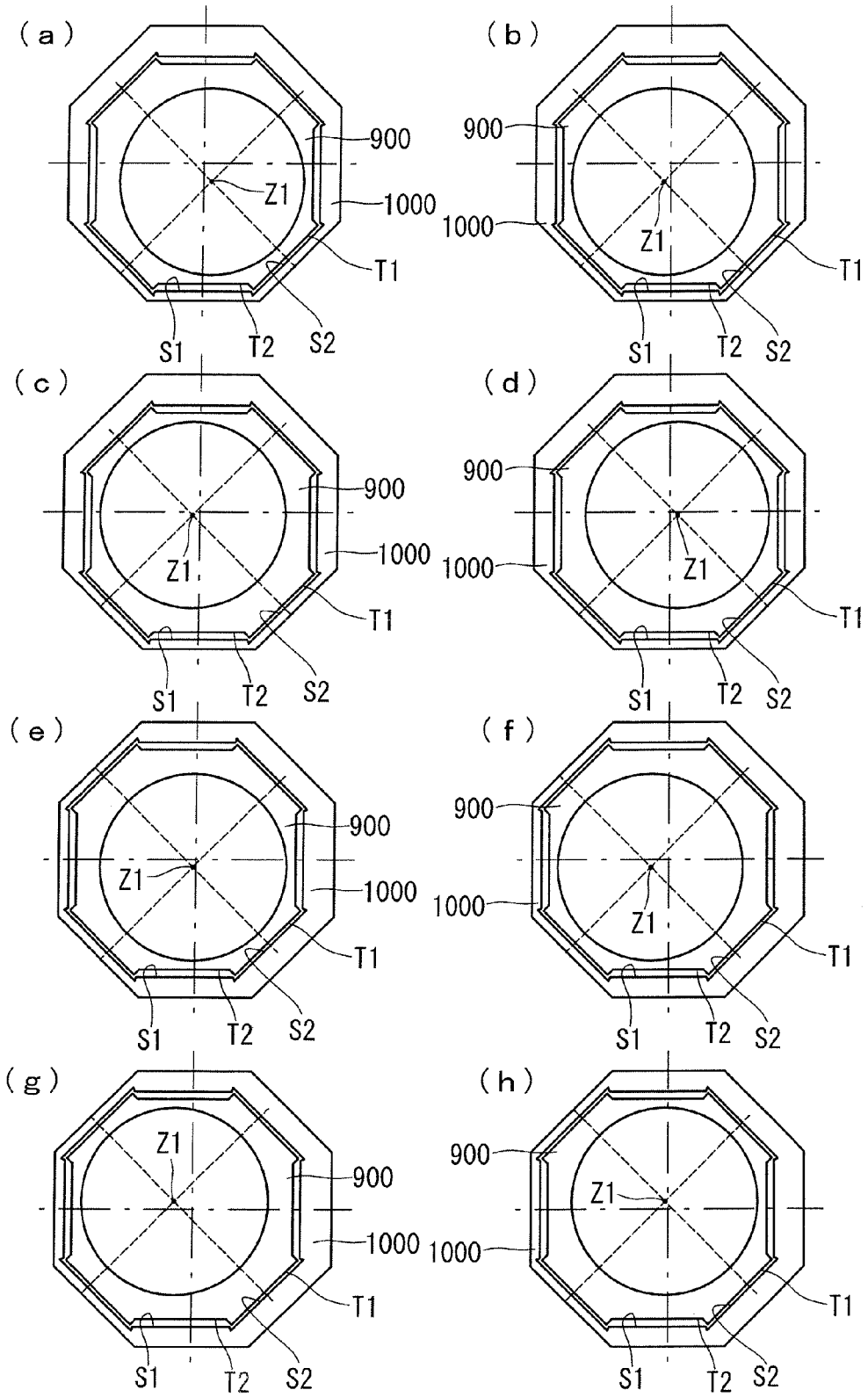
FIG. 16 is also bottom views of the lower end face of the shaft, and showing variation in the positions of the axis line of the shaft in the second embodiment.
Figure 17:
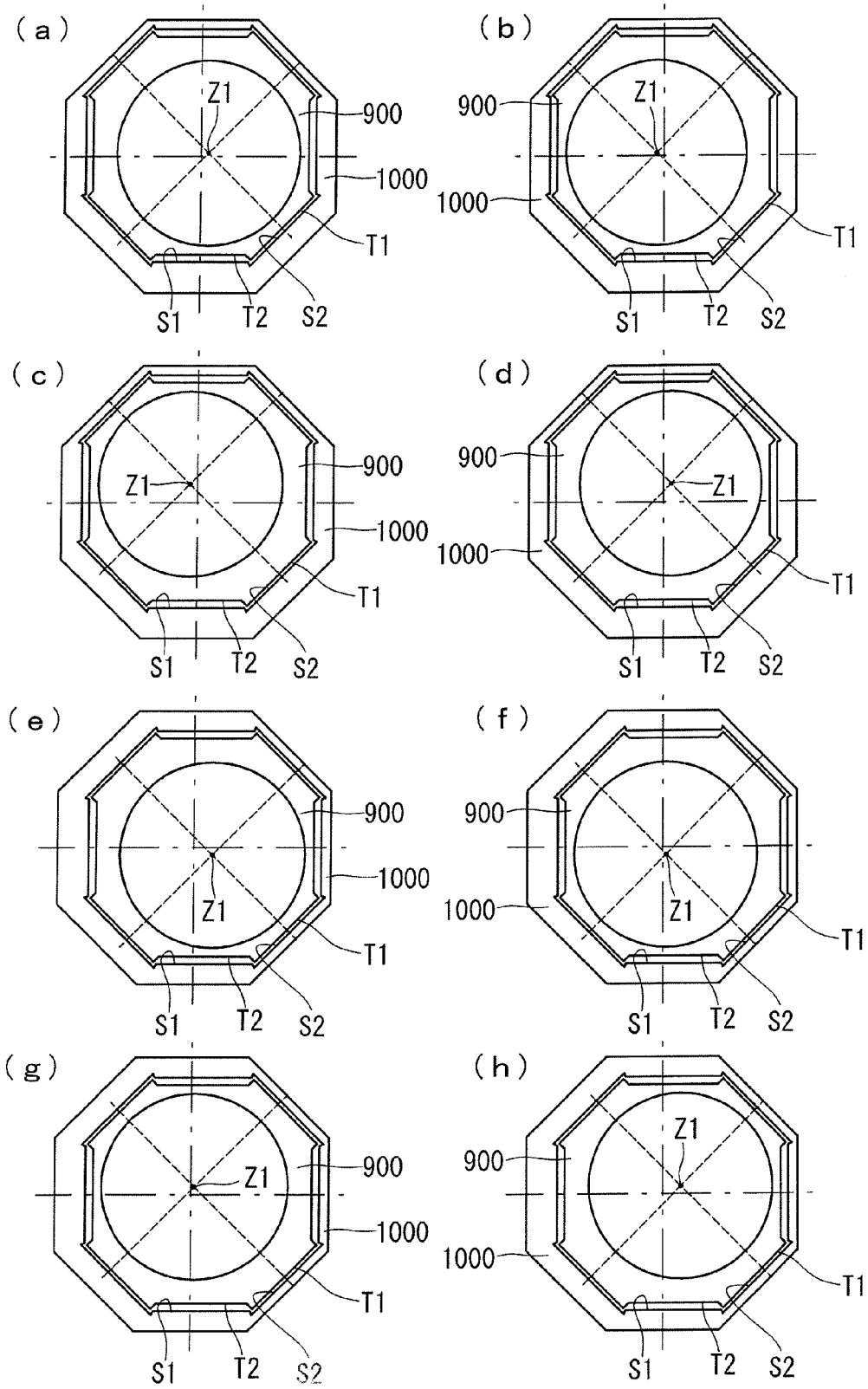
FIG. 17 is also bottom views of the lower end face of the shaft, and showing variation in the positions of the axis line of the shaft in the second embodiment.

FIGS. 14 to 17 are plan views of an end surface (lower end surface) of the reverse-tapered engagement part in the golf club 600. FIGS. 16 and 17 show the above-mentioned shifting state. As described above, in the sleeve 900, the axis line Z1 of the inner surface 902 is inclined with respect to the axis line of the outer surface 904. In addition, in the spacer 1000, the axis line Z2 of the inner surface 1002 is inclined with respect to the axis line of the outer surface 1004 (see FIG. 11).

These inclinations enable the golf club 600 to include a shaft angle adjustment mechanism. The direction of the axis line of the shaft is three-dimensionally changed depending on the rotation position of the sleeve 900 to adjust the shaft angle. In addition, the direction of the axis line of the shaft is three-dimensionally changed depending on the rotation position of the spacer 1000 to adjust the shaft angle. The degree of freedom of adjustment of the shaft angle is enhanced by the combination of the two shaft angle adjustment mechanisms.

The sleeve 900 can be rotated around the axis line of the sleeve itself. The rotation position of the sleeve 900 is changed by the rotation. In the engagement state, the sleeve can take a plurality of rotation positions. The number of the rotation positions which can be taken is set based on the shape of the outer surface of the sleeve 900.

The spacer 1000 can be rotated around the axis line of the spacer itself. The rotation position of the spacer 1000 is changed by the rotation. In the engagement state, the spacer 1000 can take a plurality of rotation positions. The number of the rotation positions which can be taken is set based on the shape of the outer surface of the spacer 1000.

Thus, the axis line of the shaft hole (axis line of the shaft 800) may be inclined with respect to the axis line of the outer surface of the sleeve 900. In addition, these axis lines may be displaced in parallel to each other (parallel eccentric). Inclination and eccentricity may be combined. In this case, the direction and/or the position of the axis line of the shaft can be changed by the rotation position of the sleeve 900.

This holds true for the spacer 1000. The axis line of the inner surface of the spacer 1000 may be inclined or may be displaced in parallel (parallel eccentric) with respect to the axis line of the outer surface of the spacer 1000. Further, inclination and eccentricity may be combined. In this case, the direction and/or the position of the axis line of the shaft 800 can be changed by the rotation position of the spacer 1000.

The term "parallel eccentric" means eccentricity in which axis lines are parallel to each other.

The rotation of the sleeve 900 and the rotation of the spacer 1000 are independent from each other. The rotation position of the spacer 1000 can be selected independently of the rotation position of the sleeve 900. Therefore, the degree of freedom of adjustability is enhanced.

FIGS. 14 to 17 are plan views of the end face (lower end face) of the reverse-tapered engagement part of the golf club 600. FIG. 16 and FIG. 17 show the above-mentioned shifting state. In each figure, the intersection point of one-dot chain lines shows the position of the axis line of the hosel hole (reverse-tapered inner surface) 704. The intersection point of dashed lines shows the position of the axis line Z1 of the shaft. In FIGS. 14 to 17, the shaft is not depicted.

In the second embodiment, the number of rotation positions which the sleeve 900 can take is eight. Four of the eight rotation positions form the first state (state in which the club length is short), and the remaining four form the second state (in which the club length is long). The number of rotation positions which the spacer 1000 can take is eight. The number of combinations of the rotation positions of the sleeve 900 and the rotation positions of the spacer 1000 is 64 (8×8=64). Of the 64 combinations, 32 combinations are shown in FIGS. 14 to 17. In FIGS. 14 and 15, the golf club 600 is in the first state (in which the club length is short). In FIGS. 16 and 17, the golf club 600 is in the second state (in which the club length is long).

Hereinafter, the respective rotation positions of the sleeve 900 and the spacer 1000 are referred to as a first position, a second position . . . in a clockwise order.

In symbol (a) of FIG. 14, the rotation position of the sleeve 900 is on the first position, and the rotation position of the spacer 1000 is on the first position.

In symbol (b) of FIG. 14, the rotation position of the sleeve 900 is on the third position, and the rotation position of the spacer 1000 is on the first position.

In symbol (c) of FIG. 14, the rotation position of the sleeve 900 is on the fifth position, and the rotation position of the spacer 1000 is on the first position.

In symbol (d) of FIG. 14, the rotation position of the sleeve 900 is on the seventh position, and the rotation position of the spacer 1000 is on the first position.

In symbol (e) of FIG. 14, the rotation position of the sleeve 900 is on the first position, and the rotation position of the spacer 1000 is on the third position.

In symbol (f) of FIG. 14, the rotation position of the sleeve 900 is on the third position, and the rotation position of the spacer 1000 is on the third position.

In symbol (g) of FIG. 14, the rotation position of the sleeve 900 is on the fifth position, and the rotation position of the spacer 1000 is on the third position.

In symbol (h) of FIG. 14, the rotation position of the sleeve 900 is on the seventh position, and the rotation position of the spacer 1000 is on the third position.

In symbol (a) of FIG. 15, the rotation position of the sleeve 900 is on the first position, and the rotation position of the spacer 1000 is on the fifth position.

In symbol (b) of FIG. 15, the rotation position of the sleeve 900 is on the third position, and the rotation position of the spacer 1000 is on the fifth position.

In symbol (c) of FIG. 15, the rotation position of the sleeve 900 is on the fifth position, and the rotation position of the spacer 1000 is on the fifth position.

In symbol (d) of FIG. 15, the rotation position of the sleeve 900 is on the seventh position, and the rotation position of the spacer 1000 is on the fifth position.

In symbol (e) of FIG. 15, the rotation position of the sleeve 900 is on the first position, and the rotation position of the spacer 1000 is on the seventh position.

In symbol (f) of FIG. 15, the rotation position of the sleeve 900 is on the third position, and the rotation position of the spacer 1000 is on the seventh position.

In symbol (g) of FIG. 15, the rotation position of the sleeve 900 is on the fifth position, and the rotation position of the spacer 1000 is on the seventh position.

In symbol (h) of FIG. 15, the rotation position of the sleeve 900 is on the seventh position, and the rotation position of the spacer 1000 is on the seventh position.

In symbol (a) of FIG. 16, the rotation position of the sleeve 900 is on the eighth position, and the rotation position of the spacer 1000 is on the first position.

In symbol (b) of FIG. 16, the rotation position of the sleeve 900 is on the second position, and the rotation position of the spacer 1000 is on the first position.

In symbol (c) of FIG. 16, the rotation position of the sleeve 900 is on the fourth position, and the rotation position of the spacer 1000 is on the first position.

In symbol (d) of FIG. 16, the rotation position of the sleeve 900 is on the sixth position, and the rotation position of the spacer 1000 is on the first position.

In symbol (e) of FIG. 16, the rotation position of the sleeve 900 is on the eighth position, and the rotation position of the spacer 1000 is on the third position.

In symbol (f) of FIG. 16, the rotation position of the sleeve 900 is on the second position, and the rotation position of the spacer 1000 is on the third position.

In symbol (g) of FIG. 16, the rotation position of the sleeve 900 is on the fourth position, and the rotation position of the spacer 1000 is on the third position.

In symbol (h) of FIG. 16, the rotation position of the sleeve 900 is on the sixth position, and the rotation position of the spacer 1000 is on the third position.

In symbol (a) of FIG. 17, the rotation position of the sleeve 900 is on the eighth position, and the rotation position of the spacer 1000 is on the fifth position.

In symbol (b) of FIG. 17, the rotation position of the sleeve 900 is on the second position, and the rotation position of the spacer 1000 is on the fifth position.

In symbol (c) of FIG. 17, the rotation position of the sleeve 900 is on the fourth position, and the rotation position of the spacer 1000 is on the fifth position.

In symbol (d) of FIG. 17, the rotation position of the sleeve 900 is on the sixth position, and the rotation position of the spacer 1000 is on the fifth position.

In symbol (e) of FIG. 17, the rotation position of the sleeve 900 is on the eighth position, and the rotation position of the spacer 1000 is on the seventh position.

In symbol (f) of FIG. 17, the rotation position of the sleeve 900 is on the second position, and the rotation position of the spacer 1000 is on the seventh position.

In symbol (g) of FIG. 17, the rotation position of the sleeve 900 is on the fourth position, and the rotation position of the spacer 1000 is on the seventh position.

In symbol (h) of FIG. 17, the rotation position of the sleeve 900 is on the sixth position, and the rotation position of the spacer 1000 is on the seventh position.

As mentioned above, there are additional 32 possible combinations other than combinations shown in FIGS. 14 to 17, and 64 sorts in total of shaft angles can be selected. Even when the first state and the second state are separately considered, 32 sorts of shaft angles can be selected for each of the states. The degree of freedom of adjustability of the shaft angle (real loft angle and lie angle) is high.

Figure 18:
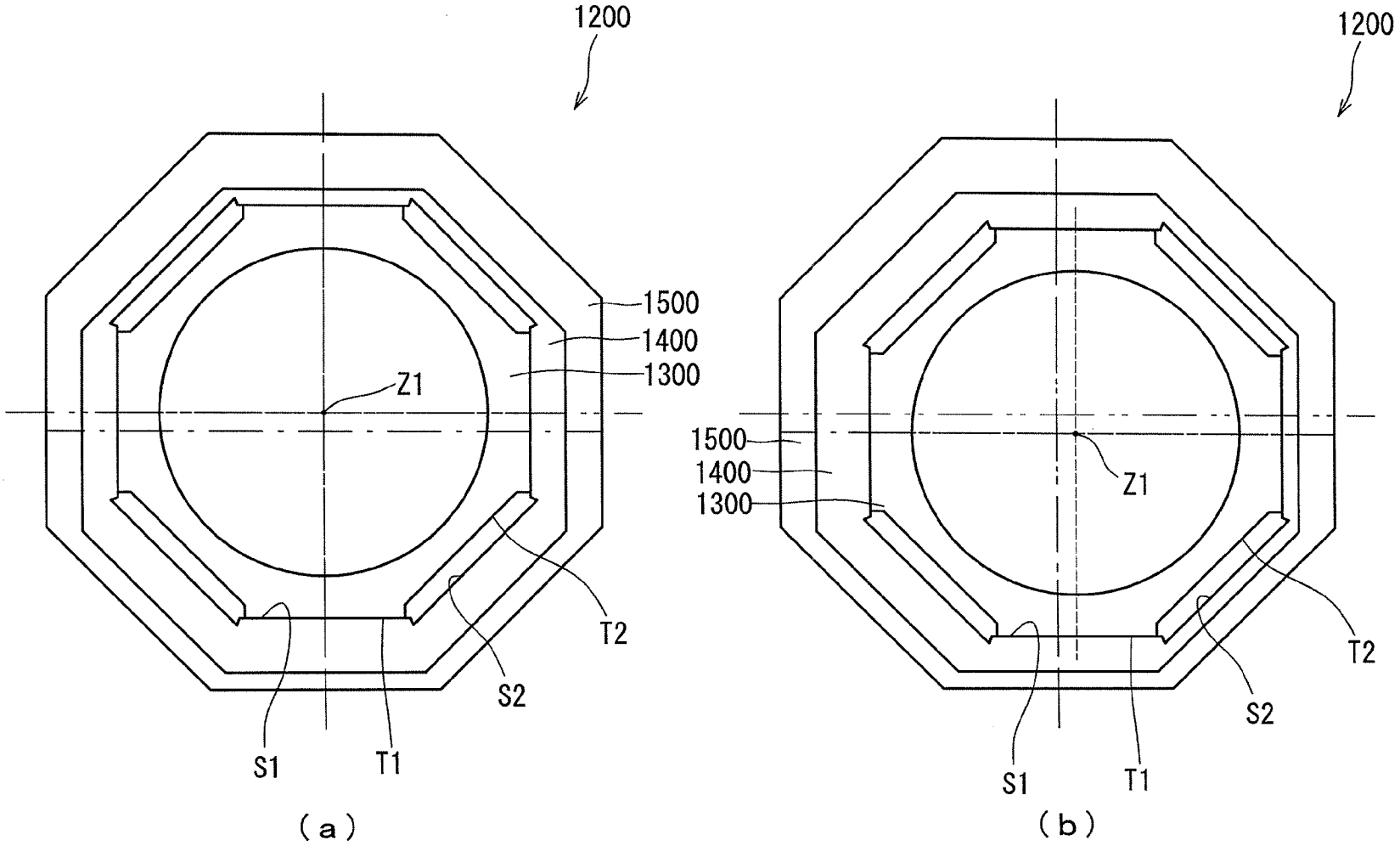
FIG. 18 is bottom views of a lower end face of a shaft, and shows variation in the positions of an axis line of the shaft in the third embodiment.
Figure 19:
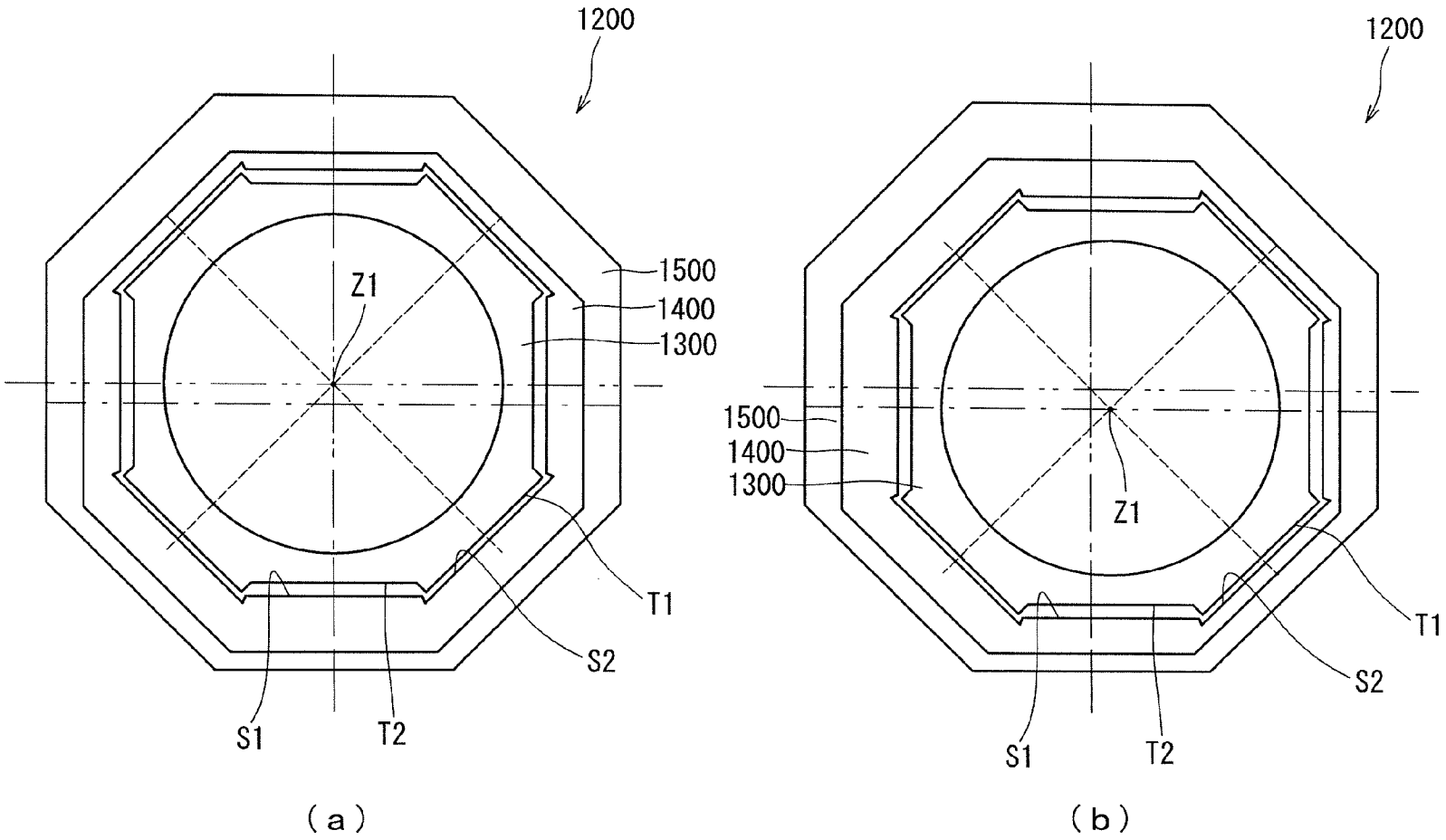
FIG. 19 is bottom views of the lower end face of the shaft, and shows variation in the positions of the axis line of the shaft in the third embodiment.

FIGS. 18 and 19 are plan views of the lower end face of a shaft assembly 1200 in a club according to a third embodiment. In FIGS. 18 and 19, the shaft is not depicted. FIG. 19 shows the above-mentioned shifting state. The shaft assembly 1200 includes one sleeve 1300 and two spacers 1400 and 1500. The first spacer 1400 is positioned inside the second spacer 1500. The first spacer 1400 is positioned between the sleeve 1300 and the second spacer 1500. The second spacer 1500 is positioned outside the first spacer 1400.

A length adjustment mechanism is provided between (the outer surface of) the sleeve 1300 and (the inner surface of) the spacer 1400. The length adjustment mechanism is the same as the length adjustment mechanism of the first and second embodiments.

A shaft angle adjustment mechanism is provided between the spacer 1400 and the spacer 1500. Although not shown in drawings, in the spacer 1400, the axis line of the inner surface is inclined with respect to the axis line of the outer surface. In addition, in the spacer 1500, the axis line of the inner surface is inclined with respect to the axis line of the outer surface.

FIG. 18 shows two examples among variations of shaft angles in the first state (in which the club length is short). FIG. 19 shows two examples among variations of shaft angles in the second state (in which club length is long). In the present embodiment, angle adjustment mechanisms are provided in the spacer 1400 and the spacer 1500. That is, two angle adjustment mechanisms are provided. The number of variations of angles of the axis line Z1 of the shaft is 64 ((8×8=64).

Thus, by increasing the number of spacers, the degree of freedom for selecting the positions and the numbers of the shaft angle/position adjustment mechanism and the shaft length adjustment mechanism is enlarged. In this respect, the number of spacers is preferably one, two or more. In view of the complexity of adjustment and downsizing of the hosel part, the number of spacers is more preferably one or two.

Figure 20:
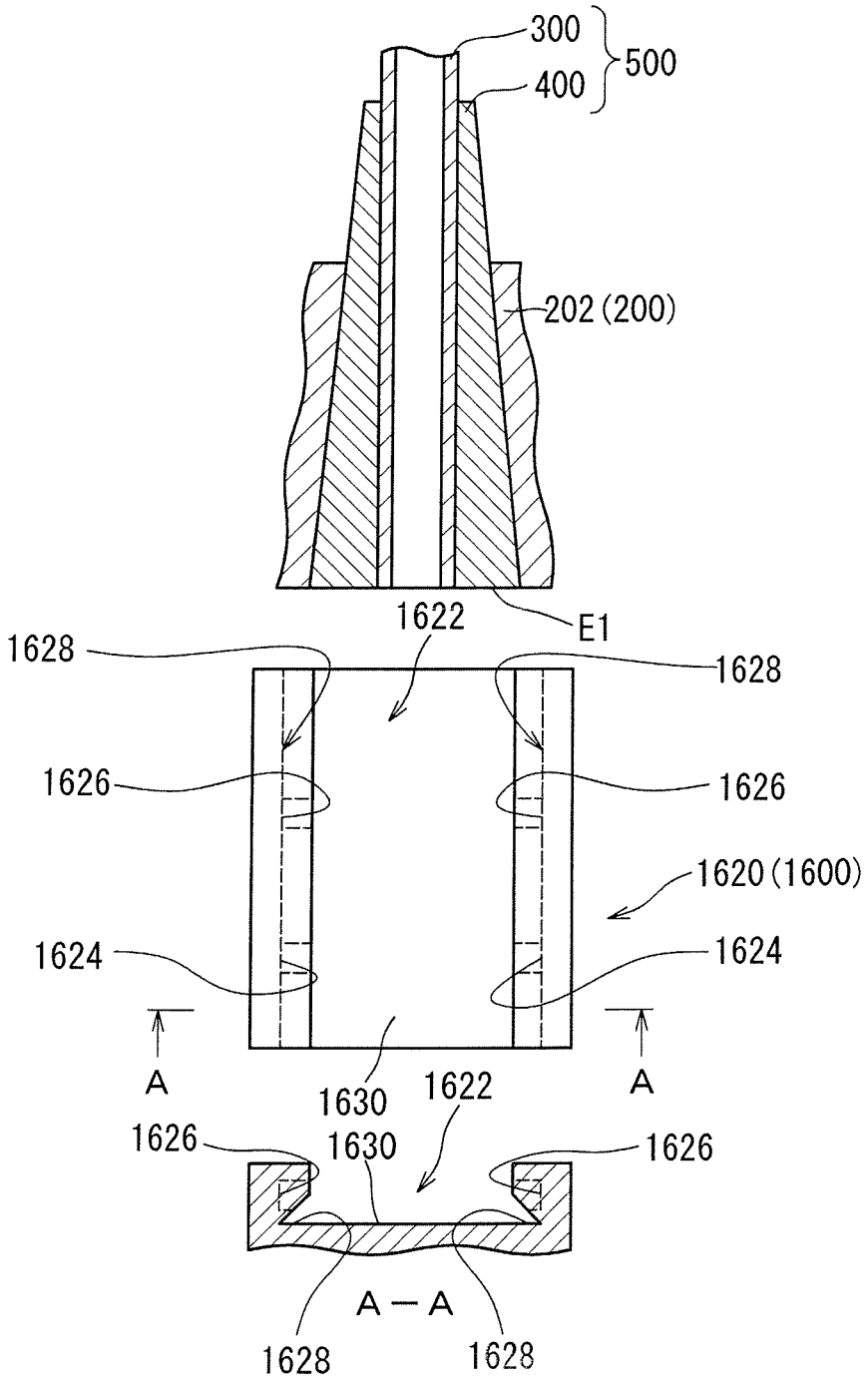
FIG. 20 is a plan view and a sectional view showing a slide part of a falling-off prevention part according to a modification example.
Figure 21A:
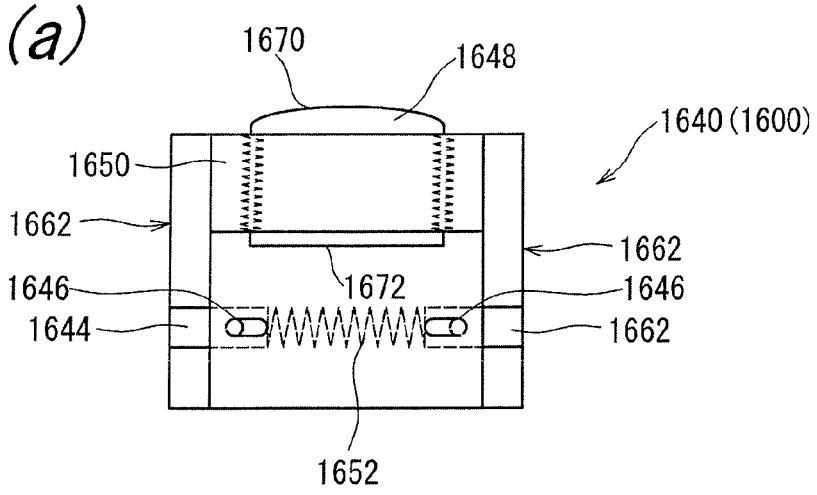
FIG. 21(*a*) is a plan view showing a slide body of the falling-off prevention part according to the modification example, and FIG. 21(*b*) is a back view showing the slide body of the falling-off prevention part according to the modification example.
Figure 21B:
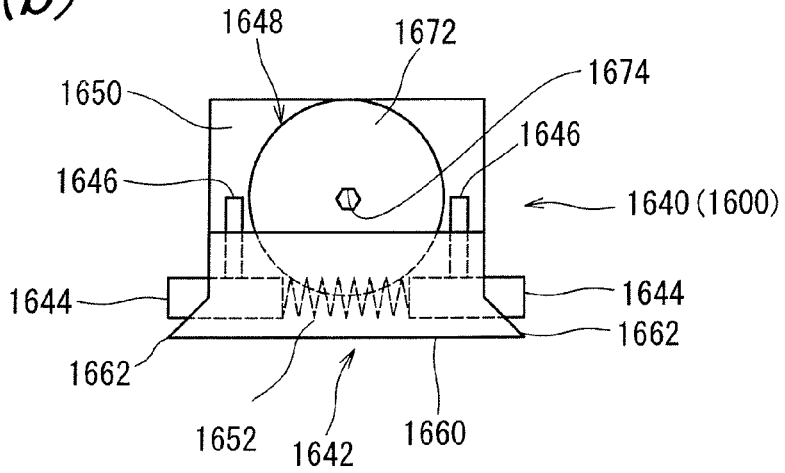

FIG. 20, FIG. 21 (*a*), and FIG. 21(*b*) show a falling-off prevention part 1600 according to a modification example. The falling-off prevention part 1600 has a slide rail part 1620 and a slide body 1640.

The slide rail part 1620 is provided on an installation surface 222 (see FIG. 5) of the head 200. As shown in FIG. 20, the slide rail part 1620 has a slide groove 1622, first engagement parts 1624, and second engagement parts 1626. The slide groove 1622 has undercut grooves 1628 and a bottom surface 1630. The undercut grooves 1628 are provided on both sides of the slide groove 1622. The first engagement parts 1624 and the second engagement parts 1626 are recessed parts provided on both sides of the slide groove 1622.

FIG. 21(*a*) is a plan view of the slide body 1640, and FIG. 21(*b*) is a back view of the slide body 1640. The slide body 1640 has a sliding portion 1642, engagement projections 1644, handling portions 1646, an abutting member 1648, an abutting-member supporting portion 1650, and an elastic member 1652.

The sliding portion 1642 constitutes a bottom part of the slide body 1640. The sliding portion 1642 has a bottom surface 1660 and undercut engagement parts 1662. The sliding portion 1642 has a sectional shape corresponding to the sectional shape of the slide groove 1622. The undercut engagement parts 1662 has sectional shapes corresponding to the sectional shapes of the respective undercut grooves 1628.

The engagement projections 1644 are provided on both sides of the slide body 1640. The elastic member 1652 biases the engagement projections 1644 in respective projecting directions.

The handling portions 1646 are connected to the respective engagement projections 1644. By handling the handling portions 1646, the engagement projections 1644 can be moved in respective receding directions against the biasing force of the elastic member 1652.

The abutting member 1648 is a member having a cylindrical shape as a whole. The abutting member 1648 has an abutting surface 1670 and a back surface 1672. The back surface 1672 has a rotation engaging hole 1674. The abutting member 1648 can be rotated by engaging a tool (not shown) with the rotation engaging hole 1674. Because of the screw connection, the abutting member 1648 is moved in the axial direction with this rotation.

This abutting member 1648 is slidingly inserted into the slide groove 1622. The abutting member 1648 can slide in the axial direction in the slide groove 1622. In the sliding, the bottom surface 1660 slides with respect to the bottom surface 1630. In the sliding, the undercut engagement parts 1662 slide with respect to the respective undercut grooves 1628. The slide body 1640 does not fall off because of the engagement between the undercut engagement parts 1662 and the undercut grooves 1628.

An axial direction position of the first engagement parts 1624 is different from an axial direction position of the second engagement parts 1626. When the engaging projections 1644 reach the position of the first engagement parts 1624, the engaging projections 1644 are engaged with the respective first engagement parts 1624. These engagements are automatically made by the biasing force of the sliding portion 1642. For releasing the engagements, the handling parts 1646 are handled so that the engaging projections 1644 recede. Similarly, when the engaging projections 1644 reach the position of the second engagement parts 1626, the engaging projections 1644 are engaged with the respective second engagement parts 1626.

When the engaging projections 1644 are engaged with the first engagement parts 1624, the abutting surface 1670 abuts on the lower end face E1 of the club in the first state (in which the club is short: see symbol (a) in FIG. 8). When the engaging projections 1644 are engaged with the respective second engagement parts 1626, the abutting surface 1670 abuts on the lower end face E1 of the club in the second state (in which the club is long: see symbol (b2) in FIG. 8). The axial direction position of the abutting surface 1670 can be finely adjusted by axially rotating the abutting member 1648. The lower end face E1 can be pressed on the abutting surface 1670 by axially rotating the abutting member 1648.

Thus, the falling-off prevention part 1600 has the slide groove 1622, the slide body 1640 that slides in the slide groove 1622 and having the abutting surface 1670, and an engagement mechanism capable of fixing the slide body 1640 at a plurality of axial direction positions. Because of the engagement mechanism, the slide body 1640 can take the first position in which the abutting surface 1670 abuts on the lower end face E1 of the shaft assembly 500 in the first state, and the second position in which the abutting surface 1670 abuts on the lower end face E1 of the shaft assembly 500 in the second state. The falling-off prevention part 1600 surely regulates the moving of the reverse-tapered engagement part in the engagement releasing direction.

In the present application, the reverse-tapered engagement part is a concept which may be a combination of a spacer and a sleeve, or only a sleeve. The length adjustment mechanism may be formed between the outer surface of the reverse-tapered engagement part (outer surface of the sleeve or the spacer) and the hosel hole. The length adjustment mechanism may be formed between the reverse-tapered inner surface and the reverse-tapered outer surface in the reverse-tapered engagement part.

In the first embodiment, the reverse-tapered outer surface has the abutting engagement surfaces T1 and non-abutting engagement surfaces T2, and the reverse-tapered inner surface has the first abutting surfaces S1 and the second abutting surfaces S2. Naturally, the reverse of this structure is also possible. That is, the reverse-tapered inner surface may have the abutting engagement surfaces T1 and the non-abutting engagement surfaces T2, and the reverse-tapered outer surface may have the first abutting surfaces S1 and the second abutting surfaces S2.

Each of the non-abutting engagement surface T2 does not abut on the opposed surface in the first state (a). The non-abutting engagement surface T2 may abut on the opposed surface in the second state (b2).

The reverse-tapered inner surface and the reverse-tapered outer surface are not limited to the pyramid surface. It is just required that the first state in which the abutting engagement surface abuts on the first abutting surface is formed when the reverse-tapered outer surface is set on the first rotation position, and that the second state in which the abutting engagement surface abuts on the second abutting surface is formed when the reverse-tapered outer surface is set on the second rotation position. It is just required that the axial direction position of the reverse-tapered outer surface with respect to the reverse-tapered inner surface in the first state is different from that of the second state. By the constitution, the club length can be adjusted by only rotating the shaft (shaft assembly). The rotation of the shaft can be made by the simple following steps of: moving the shaft in the engagement releasing direction to temporarily release the engagement between the reverse-tapered engagement part RT and the hosel hole; rotating the shaft; and retuning the shaft to the engagement direction. The adjustment of the club length is easy.

In light of the adjustment of the shaft angle, the axis line Z1 of the inner surface of the sleeve is preferably inclined or parallel eccentric with respect to the axis line of the outer surface of the sleeve. Although a case in which the axis line Z1 is inclined is shown in the second embodiment, the axis line Z1 may be parallel eccentric. In the case of parallel eccentric, a face progression or a distance of a center of gravity can be adjusted without changing a real loft angle and a lie angle. The distance of the center of gravity means a distance between the axis line of the shaft and the center of gravity of the head. In the first embodiment, the axis line Z1 is not inclined or parallel eccentric. Needless to say, however, the axis line Z1 may be inclined and/or parallel eccentric also in the first embodiment. In light of adjustability of the shaft angle, when the spacer is provided, the axis line of the inner surface of the spacer is preferably inclined or parallel eccentric with respect to the axis line of the outer surface of the spacer.

From the viewpoint of preventing an excessively large hosel, the inclination angle of the axis line of the shaft with respect to the axis line of the outer surface of the sleeve is preferably equal to or less than 5 degrees, more preferably equal to or less than 3 degrees, and still more preferably equal to or less than 2 degrees. From the viewpoint of adjusting properties, the inclination angle is preferably equal to or greater than 0.5 degrees, more preferably equal to or greater than 1 degree, and still more preferably equal to or greater than 1.5 degrees.

From the viewpoint of preventing an excessively large hosel, the amount of eccentricity of parallel eccentricity in the sleeve is preferably equal to or less than 5 mm, more preferably equal to or less than 2 mm, and still more preferably equal to or less than 1.5 mm. From the viewpoint of adjusting properties, the amount of eccentricity of parallel eccentricity in the sleeve is preferably equal to or greater than 0.5 mm, and more preferably equal to or greater than 1.0 mm.

From the viewpoint of preventing an excessively large hosel, the inclination angle of the axis line of the inner surface of the spacer with respect to the axis line of the outer surface of the spacer is preferably equal to or less than 5 degrees, more preferably equal to or less than 3 degrees, and still more preferably equal to or less than 2 degrees. From the viewpoint of adjusting properties, the inclination angle is preferably equal to or greater than 0.5 degrees, more preferably equal to or greater than 1 degree, and still more preferably equal to or greater than 1.5 degrees.

From the viewpoint of preventing an excessively large hosel, the amount of eccentricity of parallel eccentricity in the spacer is preferably equal to or less than 5 mm, more preferably equal to or less than 2 mm, and still more preferably equal to or less than 1.5 mm. From the viewpoint of adjusting properties, the amount of eccentricity of parallel eccentricity in the spacer is preferably equal to or greater than 0.5 mm, and more preferably equal to or greater than 1.0 mm.

When the spacer is not present, the sleeve as the reverse-tapered engagement part is engaged with the reverse-tapered inner surface of the hosel hole. In this case, reverse-tapered fitting is formed between the sleeve and the reverse-tapered inner surface. In the reverse-tapered fitting, contact pressure is increased by a force in an engaging direction to form firm engaging. All large forces acting during swinging are the force in the engaging direction. Therefore, anti-rotation and retention are achieved.

When the number of the spacers is 1, the spacer located outside the sleeve is engaged with the reverse-tapered inner surface of the hosel hole. In this case, reverse-tapered fitting is formed between the spacer and the reverse-tapered inner surface. In addition, reverse-tapered fitting is formed between the sleeve and the spacer. In these reverse-tapered fittings, contact pressure is increased by a force in an engaging direction to form firm engaging. Therefore, anti-rotation and retention are achieved.

When the number of the spacers is 2, the second spacer (outermost spacer) is engaged with the reverse-tapered inner surface of the hosel hole. In this case, reverse-tapered fitting is formed between the second spacer and the reverse-tapered inner surface. In addition, reverse-tapered fitting is formed between the first spacer and the second spacer. In addition, reverse-tapered fitting is formed between the sleeve and the first spacer. In these reverse-tapered fittings, contact pressure is increased by a force in an engaging direction to form firm engaging. Therefore, anti-rotation and retention are achieved.

Thus, regardless of the presence or absence and the number of spacers, anti-rotation and retention of the shaft are achieved.

The sectional area of the reverse-tapered inner surface of the hosel hole is gradually increased as going to the lower side (sole side). The sectional shape of the reverse-tapered inner surface is a non-circle. The sectional shape of the non-circle prevents relative rotation between the hosel hole and the reverse-tapered engagement part. The non-circle includes all shapes other than a circle. For example, the non-circle may be a shape having a projection, a recess, or a flat portion at at least a part in the circumferential direction of a circle. Preferably, the sectional shape of the reverse-tapered inner surface is a polygon (including a substantially polygon). Examples of the polygon include a triangle, a tetragon, a pentagon, a hexagon, a heptagon, an octagon, and a dodecagon. In light of the length adjustment mechanism, the polygon is preferably an N-sided polygon in which N is an even number, and examples of the N-sided polygon include the tetragon, the hexagon, the octagon, and the dodecagon. In view of the length adjustment mechanism, the octagon and the dodecagon are preferable, and the octagon is more preferable. The sectional shape of the reverse-tapered inner surface is more preferably a regular polygon (a substantially regular polygon). Preferable examples of the regular polygon include a regular triangle, a regular tetragon (square), a regular pentagon, a regular hexagon, a regular heptagon, a regular octagon, and a regular dodecagon. In light of the length adjustment mechanism, the regular polygon is more preferably a regular N-sided polygon in which N is an even number, and examples of the regular N-sided polygon include the regular tetragon (square), the regular hexagon, the regular octagon, and the regular dodecagon. The regular octagon and the regular dodecagon are more preferable, and the regular octagon is still more preferable.

The reverse-tapered inner surface of the hosel hole preferably includes a plurality of surfaces. Each of the surfaces may be a plane, or may be a curved surface. From the viewpoint of ensuring surface contact with the reverse-tapered engagement part, each of these surfaces is preferably a plane.

From the viewpoint of ensuring surface contact with the reverse-tapered engagement part, the reverse-tapered inner surface of the hosel hole preferably includes a pyramid inner surface. Examples of the pyramid inner surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of the length adjustment mechanism, the eight-sided pyramid surface and the twelve-sided pyramid surface are more preferable, and the eight-sided pyramid surface is still more preferable.

As described above, the club of the present disclosure has the sleeve. The inner surface of the sleeve (shaft hole) has the same shape as the shape of the tip portion of the shaft inserted into the sleeve. Usually, the sectional shape of the shaft hole is a circle. Typically, the inner surface of the sleeve (shaft hole) and the outer surface of the shaft are bonded by an adhesive.

The area of a figure including a sectional line of the outer surface of the sleeve as an outer edge is larger as going to a lower side (sole side). The sectional shape of the outer surface of the sleeve is a non-circle. The sectional shape of the non-circle prevents relative rotation between the sleeve and an abutting portion. The abutting portion is the inner surface of the spacer or the reverse-tapered inner surface of the hosel hole. When a plurality of spacers are present, the abutting portion is the inner surface of the innermost spacer. The non-circle includes all shapes other than a circle. For example, the non-circle may be a shape having a projection, a recess, or a flat portion at at least a part in the circumferential direction of a circle. Preferably, the sectional shape of the outer surface of the sleeve is a polygon (including a substantially polygon). Examples of the polygon include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In light of club length mechanism, the octagon and the dodecagon are preferable and the octagon is still more preferable. The sectional shape of the outer surface of the sleeve is more preferably a regular polygon (including a substantially regular polygon). Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of length adjustment mechanism, the regular octagon and the regular dodecagon are more preferable, and the regular octagon is still more preferable.

The outer surface of the sleeve preferably includes a plurality of surfaces. Each of the surfaces may be a plane, or may be a curved surface. From the viewpoint of ensuring surface contact with the abutting portion, each of these surfaces is preferably a plane. From the viewpoint of ensuring surface contact with the abutting portion, the outer surface of the sleeve is preferably a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of length adjustment mechanism, the eight-sided pyramid surface and the twelve-sided pyramid surface are more preferable, and the eight-sided pyramid surface is still more preferable.

As described above, the club of the present disclosure may have one or more spacers. The inner surface of the spacer preferably has the same shape as the shape of an outer surface of a member (inner member) internally fitted to the spacer. The "same shape" means a concept in which difference caused by the presence or absence of the length adjustment mechanism is not considered. The inner member is the sleeve or another spacer.

The area of a figure including a sectional line of the inner surface of the spacer as an outer edge is gradually increased as going to a lower side (sole side). The sectional shape of the inner surface of the spacer is a non-circle. The sectional shape of the non-circle prevents relative rotation between the spacer and the inner member. When a plurality of spacers are present, the inner member is another spacer. The non-circle includes all shapes other than a circle. For example, the non-circle may be a shape having a projection, a recess, or a flat portion at at least apart in the circumferential direction of a circle. Preferably, the sectional shape of the inner surface of the spacer is a polygon (including a substantially polygon). Examples of the polygon include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In light of the length adjustment mechanism, the octagon and the dodecagon are preferable. The sectional shape of the inner surface of the spacer is more preferably a regular polygon (including a substantially regular polygon).

Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of the length adjustment mechanism, the regular octagon and the regular dodecagon are more preferable, and the regular octagon is still more preferable.

The inner surface of the spacer preferably includes a plurality of surfaces. Each of the surfaces may be a plane, or may be a curved surface. From the viewpoint of ensuring surface contact with the inner member, each of these surfaces is preferably a plane. From the viewpoint of ensuring surface contact with the inner member, the inner surface of the spacer is preferably a pyramid inner surface. Examples of the pyramid inner surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface.

The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of the length adjustment mechanism, the eight-sided pyramid surface and the twelve-sided pyramid surface are more preferable, and the eight-sided pyramid surface is still more preferable.

The area of a figure including a sectional line of the outer surface of the spacer as an outer edge is gradually increased as going to a lower side (sole side). The sectional shape of the outer surface of the spacer is a non-circle. The sectional shape of the non-circle prevents relative rotation between the spacer and an abutting portion. The abutting portion is the inner surface of another spacer or the reverse-tapered inner surface of the hosel hole. The non-circle includes all shapes other than a circle. For example, the non-circle may be a shape having a projection, a recess, or a flat portion at at least a part in the circumferential direction of a circle. Preferably, the sectional shape of the outer surface of the spacer is a polygon (including a substantially polygon). Examples of the polygon include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In view of the length adjustment mechanism, the octagon and the dodecagon are preferable, and the octagon is more preferable. The sectional shape of the outer surface of the spacer is more preferably a regular polygon (including a substantially regular polygon). Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of the length adjustment mechanism, the regular octagon and the regular dodecagon are more preferable, and the regular octagon is still more preferable.

The outer surface of the spacer preferably includes a plurality of surfaces. Each of the surfaces may be a plane, or may be a curved surface. From the viewpoint of ensuring surface contact with the reverse-tapered inner surface, each of these surfaces is preferably a plane. From the viewpoint of ensuring surface contact with the reverse-tapered inner surface, the outer surface of the spacer is preferably a pyramid outer surface. Examples of the pyramid outer surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid outer surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of the length adjustment mechanism, the eight-sided pyramid surface and the twelve-sided pyramid surface are more preferable, and the eight-sided pyramid surface is still more preferable.

As described above, the club of the present disclosure has the reverse-tapered engagement part. The reverse-tapered engagement part may include only the sleeve, or may include the sleeve and one or more spacers. When the spacer is not used, the outer surface of the reverse-tapered engagement part is the outer surface of the sleeve. When one spacer is used, the outer surface of the reverse-tapered engagement part is the outer surface of the spacer. When two or more spacers are used, the outer surface of the reverse-tapered engagement part is the outer surface of the outermost spacer.

The area of a figure including a sectional line of the outer surface of the reverse-tapered engagement part as an outer edge is gradually increased as going to a lower side (sole side). The sectional shape of the outer surface of the reverse-tapered engagement part is a non-circle. The sectional shape of the non-circle prevents relative rotation between the reverse-tapered engagement part and the reverse-tapered inner surface. The non-circle includes all shapes other than a circle. For example, the non-circle may be a shape having a projection, a recess, or a flat portion at at least a part in the circumferential direction of a circle. Preferably, the sectional shape of the outer surface of the reverse-tapered engagement part is a polygon. Examples of the polygon (including a substantially polygon) include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In light of the length adjustment mechanism, the octagon and the dodecagon are preferable, and the octagon is more preferable. The sectional shape of the outer surface of the reverse-tapered engagement part is more preferably a regular polygon (including a substantially regular polygon). Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of the length adjustment mechanism, the regular octagon and the regular dodecagon are preferable, and the regular octagon is more preferable.

The outer surface of the reverse-tapered engagement part preferably includes a plurality of surfaces. Each of the surfaces may be a plane, or may be a curved surface. From the viewpoint of ensuring surface contact with the reverse-tapered inner surface, each of these surfaces is preferably a plane.

From the viewpoint of ensuring surface contact with the reverse-tapered inner surface, the outer surface of the reverse-tapered engagement part is preferably a pyramid outer surface. Examples of the pyramid outer surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid outer surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of the length adjustment mechanism, the eight-sided pyramid surface and the twelve-sided pyramid surface are more preferable, and the eight-sided pyramid surface is still more preferable.

Each of the above-mentioned Ns is preferably an integer of equal to or greater than 3.

Thus, the reverse-tapered fitting is formed by the sleeve and the reverse-tapered inner surface while the spacer is interposed as necessary. By the force in the engagement releasing direction, the reverse-tapered fitting is easily released. In addition, the reverse-tapered fitting is easily formed by the force in the engaging direction. The shaft is easily attached to, and detached from the head.

From the viewpoint of the Golf Rules, it is preferable that the falling-off prevention part cannot be released by bare hands. From the viewpoint of the Golf Rules, it is preferable that a special tool is required for the falling-off prevention part.

The material of the sleeve is not limited. Preferable examples of the material include a titanium alloy, stainless steel, an aluminum alloy, a magnesium alloy, and a resin. From the viewpoint of strength and lightweight properties, for example, the aluminum alloy and the titanium alloy are more preferable. It is preferable that the resin has excellent mechanical strength. For example, the resin is preferably a resin referred to as an engineering plastic or a super-engineering plastic.

The material of the spacer is not limited. Preferable examples of the material include a titanium alloy, stainless steel, an aluminum alloy, a magnesium alloy, and a resin. From the viewpoint of strength and lightweight properties, for example, the aluminum alloy and the titanium alloy are more preferable. It is preferable that the resin has excellent mechanical strength. For example, the resin is preferably a resin referred to as an engineering plastic or a super-engineering plastic. From the viewpoint of moldability, the resin is preferable.

As described above, the golf club of the embodiments has: an adjustment mechanism capable of adjusting the position and/or the angle of the axis line of the shaft; and an adjustment mechanism capable of adjusting the club length. The adjusting mechanism preferably satisfies the Golf Rules defined by R&A (The Royal and Ancient Golf Club of Saint Andrews). That is, the adjusting mechanism preferably satisfies requirements specified in "1b Adjustability" in "1. Clubs" of "Appendix II Design of Clubs" defined by R&A. The requirements specified in the "1b Adjustability" are the following items (i), (ii), and (iii):

(i) the adjustment cannot be readily made;

(ii) all adjustable parts are firmly fixed and there is no reasonable likelihood of them working loose during a round; and (iii) all configurations of adjustment conform to the Rules.

A usual golf club has a ferrule. However, in the golf club according to the present embodiment, the ferrule may become an obstacle when the reverse-tapered engagement part and the reverse-tapered inner surface are fitted to each other. The ferrule may become an obstacle also when the spacer is moved on the shaft. Therefore, the golf club preferably has no ferrule. From the viewpoint of obtaining an appearance close to the appearance of the ferrule, the upper end part of the sleeve is preferably exposed above the hosel end face in the engagement state. When the golf club has the spacer, the upper end part of the sleeve and the upper end part of the spacer are preferably exposed above the hosel end face in the engagement state. In this case, the upper end of the sleeve is more preferably above the upper end of the spacer. These exposed portions can exhibit the appearance close to the appearance of the ferrule.

EXAMPLES

Hereinafter, the effects of the present disclosure will be clarified by Examples. However, the present disclosure should not be interpreted in a limited way based on the description of the Examples.

Example 1

The same golf club as the above-mentioned golf club 100 was produced as Example 1.

A head made of a titanium alloy was obtained by a known method. A reverse-tapered inner surface of the hosel hole was formed by casting, and then finished to a predetermined size by NC process. A sleeve was made of an aluminum alloy. A process for manufacturing the sleeve was NC process. The sleeve was fixed to a tip portion of the shaft by an adhesive, to obtain a shaft assembly.

According to the procedure described in FIG. 4, the shaft assembly was mounted to the head to obtain a golf club in an engagement state. When a ball was actually hit by the golf club, retention and anti-rotation functioned completely, to obtain the same hitting as the hitting by a usual golf club. A reverse-tapered fitting between a hosel hole and a reverse-tapered engagement part was maintained by a falling-off prevention part. The reverse-tapered fitting was maintained also when a sole surface abuts on the ground in addressing.

The reverse-tapered fitting was temporarily released, the shaft assembly was rotated, and the reverse-tapered fitting was formed again. The mutual shifting between the first state and the second state was achieved by the process. The club length was easily changed.

Example 2

The same golf club as the above-mentioned golf club 600 was produced as Example 2.

A head made of a titanium alloy was obtained by a known method. A reverse-tapered inner surface of the hosel hole was formed by casting, and then finished to a predetermined size by NC process. A sleeve was made of an aluminum alloy. A process for manufacturing the sleeve was NC process. A spacer was made of an aluminum alloy. A process for manufacturing the spacer was NC process. A known carbon shaft was used as a shaft. The shaft was made to pass through the spacer, and the sleeve was then fixed to a tip portion of the shaft by an adhesive, to obtain a shaft assembly.

According to the procedure described in FIG. 12, the shaft assembly was mounted to the head to obtain a golf club in an engagement state. When a ball was actually hit by the golf club, retention and anti-rotation functioned completely, to obtain the same hitting as the hitting by a usual golf club. A reverse-tapered fitting between a hosel hole and a reverse-tapered engagement part was maintained by a falling-off prevention part. The reverse-tapered fitting was maintained, also when a sole surface abuts on the ground in addressing, while not occurring the falling off of the shaft assembly.

The adjustment of the club length and the adjustment of the shaft angle were achieved by temporarily releasing the reverse-tapered fitting, and then rotating the sleeve and the spacer. These adjustments were easily made.

The disclosure described above can be applied to all golf clubs such as a wood type golf club, a hybrid type golf club, an iron type golf club, and a putter.

The above description is merely illustrative example, and various modifications can be made without departing from the principles of the present disclosure.

What is claimed is:

1. A golf club comprising:

a head having a hosel part;

a shaft; and a reverse-tapered engagement part disposed at a tip portion of the shaft, wherein:

the reverse-tapered engagement part includes a sleeve having a reverse-tapered shape and being fixed to the tip portion of the shaft, and a reverse-tapered outer surface;

the hosel part includes a hosel hole, and a hosel slit which is provided on a side of the hosel hole and enables the shaft to pass through the hosel slit;

the hosel hole has a reverse-tapered inner surface having a shape corresponding to a shape of the reverse-tapered outer surface;

either one of the reverse-tapered outer surface and the reverse-tapered inner surface has an abutting engagement surface;

the other of the reverse-tapered outer surface and the reverse-tapered inner surface has a first abutting surface and a second abutting surface;

a first state in which the abutting engagement surface abuts on the first abutting surface is formed when the reverse-tapered outer surface is set on a first rotation position, and a second state in which the abutting engagement surface abuts on the second abutting surface is formed when the reverse-tapered outer surface is set on a second rotation position; and an axial direction position of the reverse-tapered outer surface with respect to the reverse-tapered inner surface in the first state is different from that of the second state, and a club length is adjusted by the difference.

2. The golf club according to claim 1, wherein the reverse-tapered outer surface further has a non-abutting engagement surface in addition to the abutting engagement surface, the reverse-tapered outer surface is a pyramid outer surface, and the abutting engagement surface and the non-abutting engagement surface are alternately arranged on the pyramid outer surface;

a radial direction position of the abutting engagement surface is located outside with respect to a radial direction position of the non-abutting engagement surface; and the reverse-tapered inner surface is a pyramid inner surface corresponding to the pyramid outer surface, and the first abutting surface and the second abutting surface are alternately arranged on the pyramid inner surface.

3. The golf club according to claim 2, wherein the pyramid outer surface is an eight-sided pyramid surface, and the pyramid inner surface is an eight-sided pyramid surface.

4. The golf club according to claim 1, wherein the reverse-tapered engagement part is constituted with the sleeve, and at least one spacer externally fitted to the sleeve.

5. The golf club according to claim 4, wherein an axis line of an inner surface of the spacer is inclined or parallel eccentric with respect to an axis line of an outer surface of the spacer.

6. The golf club according to claim 1, wherein an axis line of an inner surface of the sleeve is inclined or parallel eccentric with respect to an axis line of an outer surface of the sleeve.

7. The golf club according to claim 1, wherein the head further includes a falling-off prevention part which regulates movement of the reverse-tapered engagement part in an engagement releasing direction.

8. The golf club according to claim 1, wherein an outer surface of the sleeve is the reverse-tapered outer surface.

9. The golf club according to claim 1, wherein the reverse-tapered outer surface has a sectional shape of a substantially polygon.

10. The golf club according to claim 1, wherein the reverse-tapered outer surface has a sectional shape of a substantially regular polygon.

11. The golf club according to claim 1, wherein an area of a figure including a sectional line of the reverse-tapered outer surface as an outer edge is larger as going to a sole side.

* * * * *